US010844600B2

(12) United States Patent
Foderberg

(10) Patent No.: US 10,844,600 B2
(45) Date of Patent: Nov. 24, 2020

(54) SYSTEM FOR INSULATED CONCRETE COMPOSITE WALL PANELS

(71) Applicant: Joel Foderberg, Overland Park, KS (US)

(72) Inventor: Joel Foderberg, Overland Park, KS (US)

( * ) Notice: Subject to any disclaimer, the term of this patent is extended or adjusted under 35 U.S.C. 154(b) by 0 days.

(21) Appl. No.: 16/430,069

(22) Filed: Jun. 3, 2019

(65) Prior Publication Data

US 2019/0284805 A1 Sep. 19, 2019

Related U.S. Application Data

(63) Continuation of application No. 16/025,568, filed on Jul. 2, 2018, now Pat. No. 10,309,105, which is a (Continued)

(51) Int. Cl.

| | |
|---|---|
| ***E04C 2/288*** | (2006.01) |
| ***E04G 17/065*** | (2006.01) |
| ***B28B 23/02*** | (2006.01) |
| ***E04C 2/04*** | (2006.01) |
| ***E04C 2/34*** | (2006.01) |
| ***E04B 2/00*** | (2006.01) |

(Continued)

(52) U.S. Cl.

CPC ..... *E04C 2/2885* (2013.01); *B28B 23/028* (2013.01); *E04C 2/044* (2013.01); *E04C 2/049* (2013.01); *E04C 2/288* (2013.01); *E04C 2/34* (2013.01); *E04C 2/46* (2013.01); *E04C 5/0645* (2013.01); *E04C 5/208* (2013.01); *E04G 17/065* (2013.01); *E04C 5/203* (2013.01); *E04C 5/206* (2013.01); *E04C 2002/045* (2013.01); *E04C 2002/047* (2013.01)

(58) Field of Classification Search

CPC ... E04B 1/41; E04B 1/61; E04C 2/044; E04C 2/049; E04C 2/34; E04C 2/46; E04C 5/0645; E04C 2002/047

See application file for complete search history.

(56) References Cited

U.S. PATENT DOCUMENTS

| | | | |
|---|---|---|---|
| 1,053,231 | A | 2/1913 | Schweikert |
| 1,088,290 | A | 2/1914 | McAllister et al. |

(Continued)

FOREIGN PATENT DOCUMENTS

| | | | |
|---|---|---|---|
| CN | 103967162 | A | 8/2014 |
| DE | 2434037 | A1 | 1/1976 |

(Continued)

OTHER PUBLICATIONS

European Extended Search Report dated Aug. 29, 2019 for related European Patent Application No. EP17796553.0, 10 pages.

(Continued)

*Primary Examiner* — Jessica L Laux

(74) *Attorney, Agent, or Firm* — Hovey Williams LLP; Kameron D. Kelly

(57) ABSTRACT

A shear connector for use with insulated concrete panels. The shear connector comprises an elongated core member that includes a first end and a second end, and a flanged end-piece removably secured to one of the first end or the second end of the core member. At least a portion of the flanged end-piece includes a maximum diameter that is larger than a maximum diameter of the core member. The shear connector is configured to transfer shear forces.

22 Claims, 15 Drawing Sheets

Related U.S. Application Data continuation of application No. 15/493,246, filed on Apr. 21, 2017, now Pat. No. 10,011,988.

(60) Provisional application No. 62/334,902, filed on May 11, 2016, provisional application No. 62/465,549, filed on Mar. 1, 2017.

(51) Int. Cl.
*E04C 5/06* (2006.01)
*E04C 5/20* (2006.01)

(56) References Cited

U.S. PATENT DOCUMENTS 1,302,727 A 5/1919 Thomas
1,503,148 A 7/1924 Bernstrom
1,682,740 A 9/1928 Colt
1,700,889 A 2/1929 Heltzel
1,801,273 A 4/1931 Himmel et al.
1,975,156 A 10/1934 Knight
2,178,782 A 11/1939 Dunlap
2,400,670 A 5/1946 William
2,412,253 A 12/1946 Diggs
2,645,929 A 7/1953 Jones
2,765,139 A 10/1956 White
2,923,146 A 2/1960 Mayer
2,018,080 A 1/1962 Loudon
3,296,763 A 1/1967 Curl
3,715,850 A 2/1973 Chambers
3,757,482 A 9/1973 Haeussler
3,832,817 A 9/1974 Martens
3,925,595 A 12/1975 Hawkins
3,940,553 A 2/1976 Hawkins
4,027,988 A 6/1977 Kum
4,037,978 A 7/1977 Connelly
4,059,931 A 11/1977 Mongan
4,107,890 A 8/1978 Seghezzi et al.
4,157,226 A 6/1979 Reiter
4,194,851 A 3/1980 Littlefield
4,223,176 A 9/1980 Hawkins
4,329,821 A 5/1982 Long et al.
4,393,635 A 7/1983 Long
4,445,308 A 5/1984 Taylor
4,471,156 A 9/1984 Hawkins
4,505,019 A 3/1985 Deinzer
4,637,748 A 1/1987 Beavers
4,640,074 A 2/1987 Paakkinen
4,673,525 A 6/1987 Small et al.
4,723,388 A 2/1988 Zieg
4,765,109 A 8/1988 Boeshart
4,805,366 A 2/1989 Long
4,829,733 A 5/1989 Long
4,852,324 A 8/1989 Page
4,904,108 A 2/1990 Wendel
4,932,808 A 6/1990 Bar et al.
5,154,034 A 10/1992 Stanek
5,252,017 A 10/1993 Hodel
5,272,850 A 12/1993 Mysliwiec et al.
5,302,039 A 4/1994 Omholt
5,371,991 A 12/1994 Bechtel et al.
5,440,845 A 8/1995 Tadros et al.
5,456,048 A 10/1995 White
5,497,592 A 3/1996 Boeshart
5,517,794 A 5/1996 Wagner
55,199,731 5/1996 Keith
5,570,552 A 11/1996 Nehring
5,606,832 A 3/1997 Keith et al.
5,628,481 A 5/1997 Rinderer
5,671,574 A 9/1997 Long
5,673,525 A 10/1997 Keith et al.
5,809,723 A 9/1998 Keith et al.
5,809,725 A 9/1998 Cretti
5,899,033 A 5/1999 Merchlewitz
5,996,297 A 12/1999 Keith et al.
6,079,176 A 6/2000 Westra et al.
6,088,985 A 7/2000 Clark
6,116,836 A 9/2000 Long, Sr.
6,138,981 A 10/2000 Keith et al.
6,148,576 A 11/2000 Janopaul, Jr. et al.
6,202,375 B1 3/2001 Kleinschmidt
6,263,638 B1 7/2001 Long, Sr.
6,276,104 B1 8/2001 Long, Sr. et al.
6,298,549 B1 10/2001 Mangone, Jr.
6,412,242 B1 7/2002 Elmer
6,467,227 B2 10/2002 Elmer
6,519,903 B1 2/2003 Dirisamer et al.
6,606,786 B2 8/2003 Mangone, Jr.
6,675,546 B2 1/2004 Coles
6,705,583 B2 3/2004 Daniels et al.
6,761,003 B2 7/2004 Lind
6,761,007 B2 7/2004 Lancelot, III et al.
6,779,241 B2 8/2004 Mangone, Jr.
6,817,156 B2 11/2004 Mok
6,860,454 B1 3/2005 Gronowicz, Jr.
6,915,613 B2 7/2005 Wostal et al.
6,945,506 B2 9/2005 Long, Sr.
7,104,718 B2 9/2006 Stoeckler
7,241,071 B2 7/2007 Carraher et al.
7,266,931 B2 9/2007 Long, Sr.
7,290,377 B2 11/2007 Dupuis
7,347,029 B2 3/2008 Wostal et al.
7,367,741 B2 5/2008 Vogler
7,469,514 B2 12/2008 Luo
7,654,056 B2 2/2010 Luo
8,083,432 B2 12/2011 Limpert
8,112,963 B2 2/2012 Johnson
8,215,075 B2 7/2012 Bergman
8,276,339 B2 10/2012 Limburg
8,312,683 B2 11/2012 Tadros et al.
8,365,501 B2 2/2013 Long et al.
8,479,469 B2 7/2013 Ciccarelli
8,555,584 B2 10/2013 Ciuperca
8,720,156 B2 5/2014 Porter
8,839,580 B2 9/2014 Long, Sr.
9,033,302 B2 5/2015 Long, Sr.
9,074,370 B2 7/2015 Long et al.
9,303,404 B2 4/2016 Naito et al.
2001/0037563 A1 11/2001 Mangone, Jr.
2002/0189178 A1 12/2002 Lind
2003/0208897 A1 11/2003 Mangone, Jr.
2003/0208987 A1 11/2003 Lancelot et al.
2004/0011943 A1 1/2004 Long, Sr.
2004/0040251 A1 3/2004 Mok
2004/0101352 A1 5/2004 Stoeckler
2004/0103609 A1 6/2004 Wostal et al.
2004/0118067 A1 6/2004 Keith
2005/0016095 A1 1/2005 Long, Sr.
2005/0108963 A1 5/2005 Wostal et al.
2005/0217198 A1 10/2005 Carrher et al.
2006/0032166 A1 2/2006 Devalapura
2007/0074478 A1 4/2007 Dupuis
2007/0175127 A1 8/2007 Tanaka
2008/0028709 A1 2/2008 Pontarolo
2008/0240846 A1 10/2008 Phillips
2008/0295425 A1 12/2008 Farag
2009/0067918 A1 3/2009 Luo
2009/0301025 A1 12/2009 Kodi
2009/0324880 A1 12/2009 Johnson
2010/0043337 A1 2/2010 Banks
2010/0132290 A1 6/2010 Luburic
2011/0265414 A1 11/2011 Ciccarelli
2011/0272556 A1 11/2011 Lin
2012/0135200 A1 5/2012 Burvill et al.
2012/0285108 A1 11/2012 Long, Sr.
2014/0075882 A1 3/2014 Porter
2014/0087158 A1 3/2014 Ciuperca
2014/0298743 A1 10/2014 Long, Sr.
2016/0010330 A1 1/2016 Naito et al.
2017/0058520 A1 3/2017 Keith et al.

(56) References Cited

U.S. PATENT DOCUMENTS

FOREIGN PATENT DOCUMENTS

| | | | |
|---|---|---|---|
| DE | 19823346 | | 1/1999 |
| EP | 0322923 | A2 | 7/1989 |
| WO | 00/12823 | A2 | 3/2000 |
| WO | 02/25023 | A2 | 3/2002 |

OTHER PUBLICATIONS

Search Report and Written Opinion for related PCT Application No. PCT/US2014/067427 filed on Nov. 25, 2014, dated Feb. 20, 2015, 11 pages.

Search Report and Written Opinion dated Jun. 24, 2015 for related PCT Application No. PCT/US2015/020344 filed on Mar. 13, 2015, 14 pages.

Clay J. Naito et al., Evaluation of Shear Tie Connectors for Use in Insulated Concrete Sandwich Panels, Air Force Research Laboratory, Tyndall Air Force Base, FL, Jan. 1, 2009, AFRL-RX-TY-TR-2009-4600, 37 pages.

Amin Ainea et al., State-of-the-Art of Precast Concrete Sandwich Panels, PCI Journal, Nov.-Dec. 1991, pp. 78-98.

Clay J. Naito et al., Precast/Prestressed Concrete Experiments Performance on Non-load Bearing Sandwich Wall Panels, Air Force Research Laboratory, Tyndall Air Force Base, FL, Jan. 2011, AFRL-RX-TY-TR-2011-0021, 160 pages.

George Morcous et al., Optimized NU Sandwich Panel System for Energy, Composite Action and Production Efficiecy, 3rd fib Internation Congress, 2010, 13 pages.

Search Report and Written Opinion for related PCT Patent Application No. PCT/US2017/028909, dated Jul. 6, 2017, 13 pages.

SYSTEM FOR INSULATED CONCRETE COMPOSITE WALL PANELS

CROSS-RELATED APPLICATIONS

The present non-provisional patent application is a continuation patent application of U.S. patent application Ser. No. 16/025,568, filed Jul. 2, 2018, entitled SYSTEM FOR INSULATED CONCRETE WALL PANELS, which is a continuation patent application of U.S. patent application Ser. No. 15/493,246, filed Apr. 21, 2017, entitled SYSTEM FOR INSULATED CONCRETE COMPOSITE WALL PANELS which claims priority to U.S. Provisional Patent Application Ser. No. 62/334,902, filed May 11, 2016, entitled "SYSTEM FOR HIGH PERFORMANCE INSULATED CONCRETE PANELS," and U.S. Provisional Patent Application Ser. No. 62/465,549, filed Mar. 1, 2017, entitled "SYSTEM FOR HIGH PERFORMANCE INSULATED CONCRETE PANELS." The entirety of the above-identified patent applications are hereby incorporated by reference into the present non-provisional patent application.

BACKGROUND

1. Field of the Invention

Embodiments of the present invention are generally directed to insulated concrete composite wall panels. More specifically, embodiments of the present invention are directed to shear connectors for connecting inner and outer concrete layers of insulated concrete composite wall panels.

2. Description of the Related Art

Insulated concrete wall panels are well known in the construction industry. In general, such insulated panels are comprised of two layers of concrete, including an inner layer and an outer layer, with a layer of insulation sandwiched between the concrete layers. In certain instances, to facilitate the connection of the inner concrete layer and the outer concrete layer, the concrete layers may be tied together with one or more shear connectors to form an insulated concrete composite wall panel ("composite panel"). The building loads typically resolved by a composite insulated wall panel are wind loads, dead loads, live loads, and seismic loads. The shear connectors are, thus, configured to provide a mechanism to transfer such loads, which are resolved by the shear connectors as shear loads, tension/compression loads, and/or bending moments. These loads act can alone, or in combination. Tension loads are known to cause delamination of the concrete layers from the insulation layer. The use of shear connectors in concrete wall panels, thus, transfer shear and tension/compression loads so as to provide for composite action of the concrete wall panels, whereby both layers of concrete work together as tension and compression members.

Previously, shear connectors have been designed in a variety of structures and formed from various materials. For instance, previously-used shear connectors were often made from steel. More recently, shear connectors have been made from glass or carbon fiber and epoxy resins. The use of these newer materials increases the overall thermal efficiency of the composite panel by allowing less thermal transfer between the inner and outer concrete layers.

The continuing evolution of building energy codes has required buildings to be more efficient, including thermally efficient. To meet new thermal efficiency requirements in concrete wall panels, the construction industry has begun using thicker layers of insulation (and thinner layers of concrete) and/or more thermally efficient insulation within the panels. However, reducing the amount of concrete used in the panels will generally educe the strength of the panels. As such, there is a need for a shear connector for composite panels that provides increased thermal efficiency, while simultaneously providing increased strength and durability of the composite panels. There is also a need for lighter-weight composite panels that can be easily transported, oriented, and installed.

SUMMARY

One or more embodiments of the present invention concern a shear connector for use with insulated concrete panels. The shear connector comprises an elongated core member that includes a first end and a second end, and a flanged end-piece removably secured to one of the first end or the second end of the core member. At least a portion of the flanged end-piece includes a maximum diameter that is larger than a maximum diameter of the core member. The shear connector is configured to transfer shear forces.

Additional embodiments of the present invention include an insulated concrete panel. The panel comprises an insulation layer having one or more openings extending therethrough, a first concrete layer adjacent to a first surface of the insulation layer, a second concrete layer adjacent to a second surface of the insulation layer, and a shear connecter received within one or more of the openings in the insulation layer. The shear connector includes an elongated core member comprising a first end and a second end, and a flanged end-piece removably secured to one of the first end or the second end of the core member. The flanged end-piece is embedded within the first concrete layer. The shear connector is configured to transfer shear forces between the first concrete layer and the second concrete layer, and to prevent delamination of the first concrete layer and the second concrete layer.

Additional embodiments of the present invention include a method of making an insulated concrete panel. The method comprises the initial step of forming one or more openings through an insulation layer, with the insulation layer including a first surface and a second surface. The method additionally includes the step of inserting at least one cylindrical core member of a shear connector into one of the openings in the insulation layer, with the core member comprising a first end and a second end. The method additionally includes the step of securing a flanged end-piece on the second end of the core member. At least a portion of the flanged end-piece is spaced from the insulation layer. The method includes the additional step of pouring a first layer of concrete. The method includes the additional step of placing the insulation layer on the first layer of concrete, such that a portion of the insulation layer is in contact with the first layer of concrete. The method includes the further step of pouring a second layer of concrete over the second surface of the insulation layer. Upon the pouring of the second layer, the flanged end-piece connected to the second end of the core member is at least partially embedded within the second layer of concrete. The core member of the shear connector is configured to transfer shear forces between the first and second layers of concrete and to resist delamination of the first and second layers of concrete.

Embodiments of the present invention further include a shear connector for use with insulated concrete panels. The shear connector comprises an elongated core member including a first end and a second end, with at least a portion of the core member being cylindrical. The shear connector comprises a first flanged section extending from the first end of the core member, with at least a portion of the first flanged section extending beyond a maximum circumference of the core member. The shear connector additionally comprises a support element extending from the first flanged section or from an exterior surface of the core member, with at least a portion of the support element being positioned between the first flanged section and the second end of the core member, and with at least a portion of the support element extending beyond the maximum circumference of the core member. The shear connector further includes a second flanged section extending from the second end of the core member, with the second flanged section not extending beyond the maximum circumference of the core member. The shear connector is configured to transfer shear forces.

BRIEF DESCRIPTION OF THE FIGURES

Embodiments of the present invention are described herein with reference to the following figures, wherein.

Figure 10:
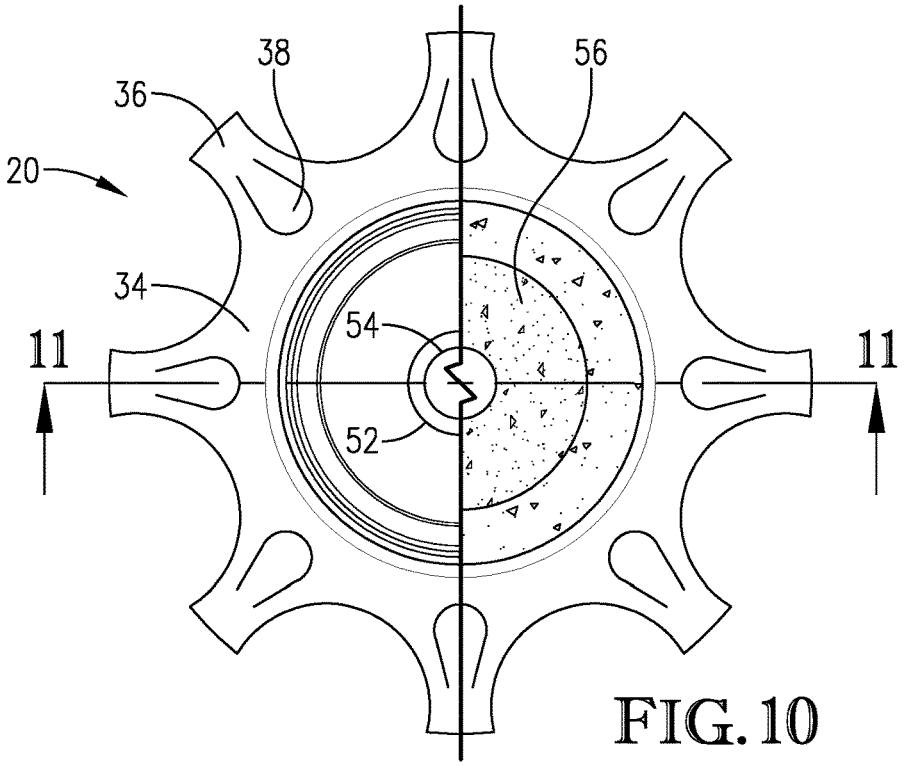
FIG. 10 is a top plan view of a shear connector with a handle rod extending through a chamber of the shear connector, with the view particularly illustrating a portion of the chamber of the shear connector being filled within concrete.
Figure 12:
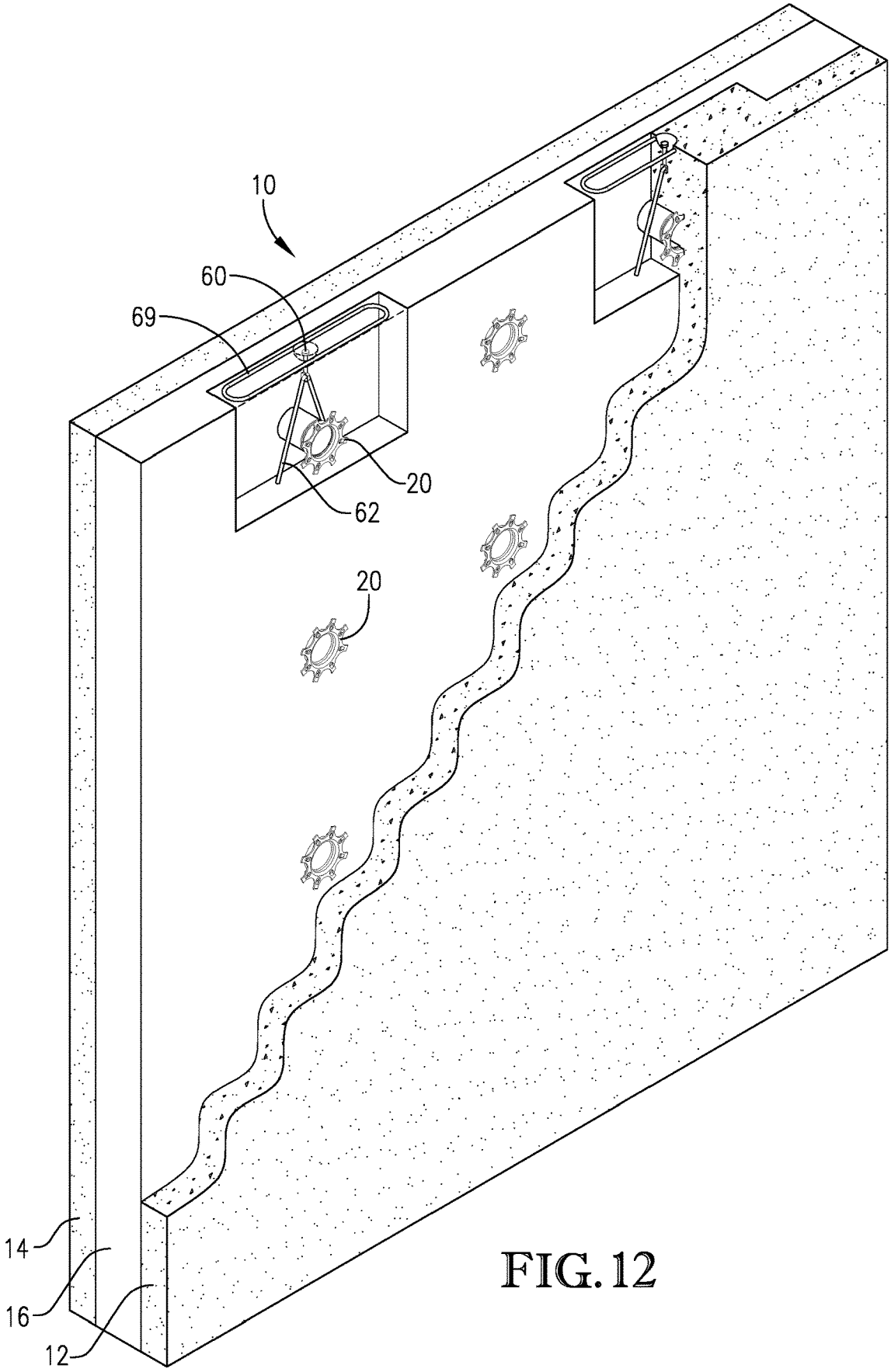
Figure 13:
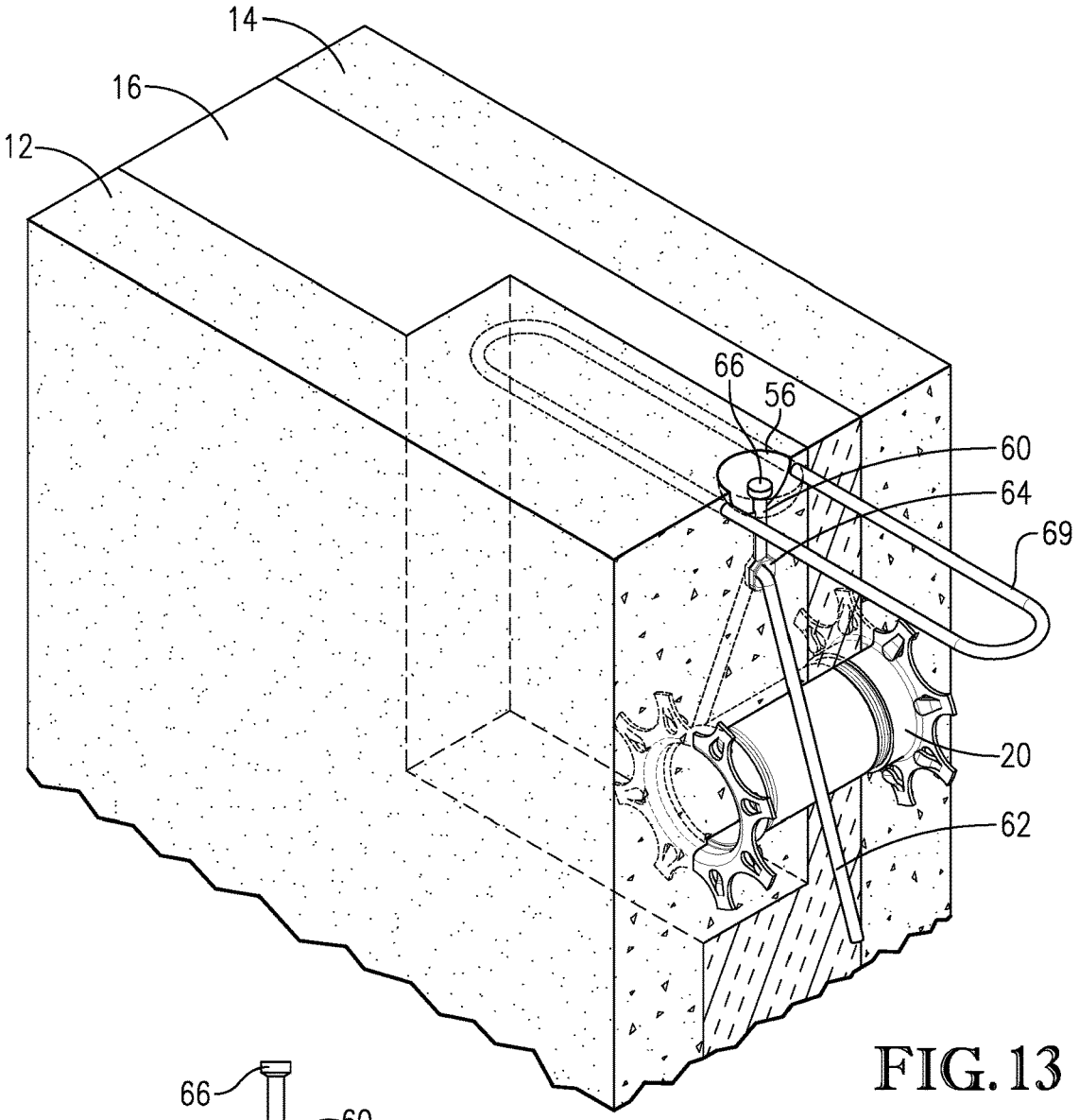
Figure 14:
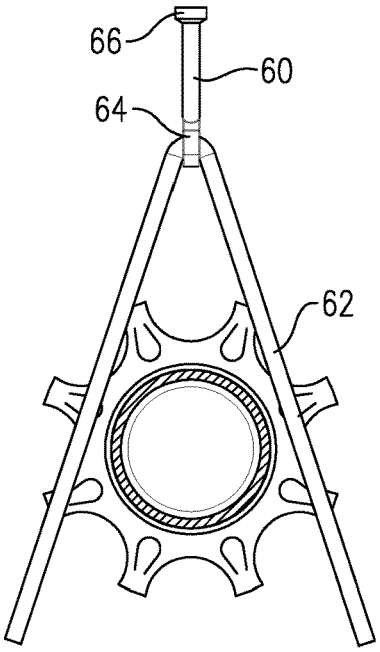
Figure 15:
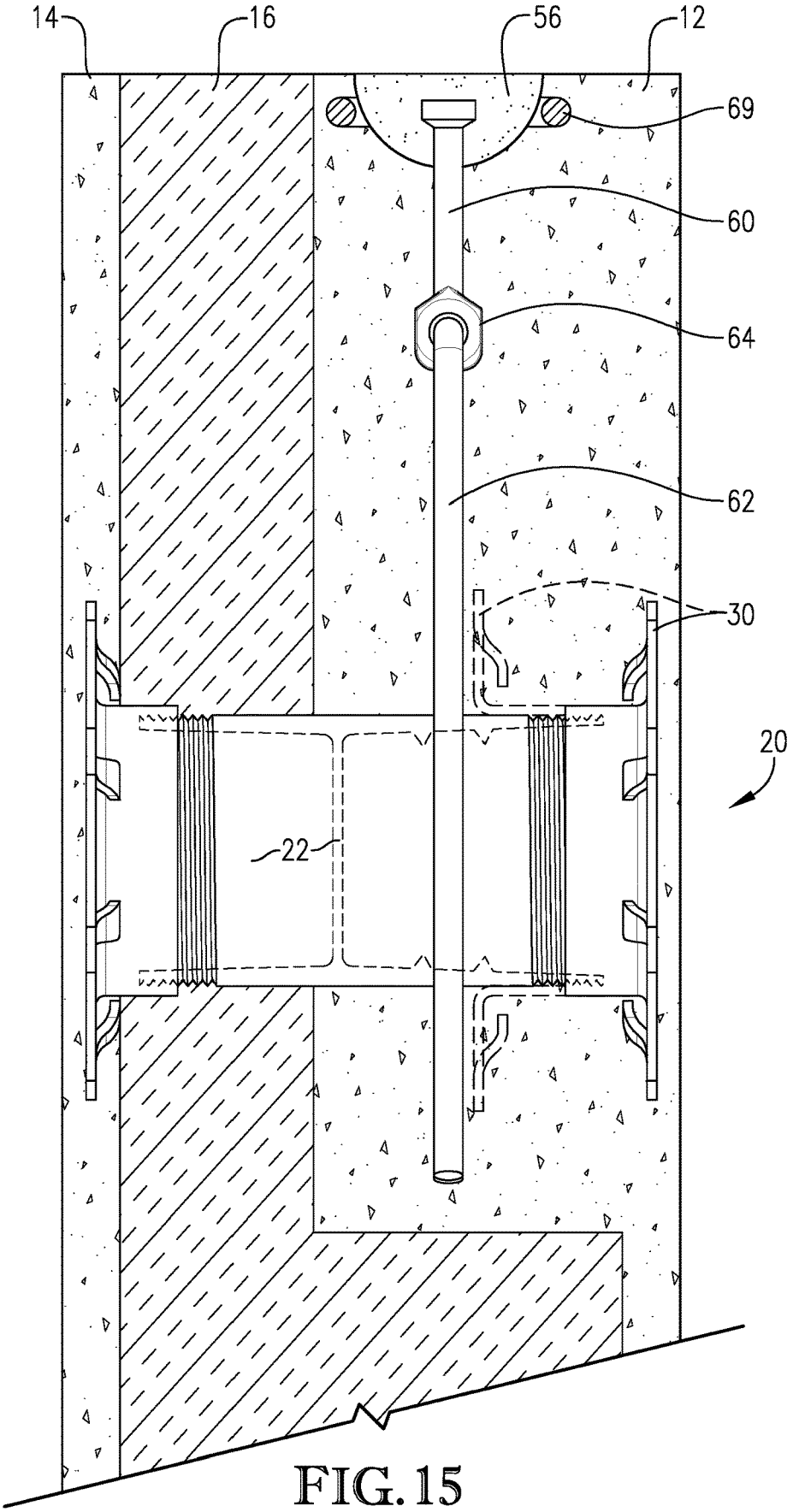
Figure 16:
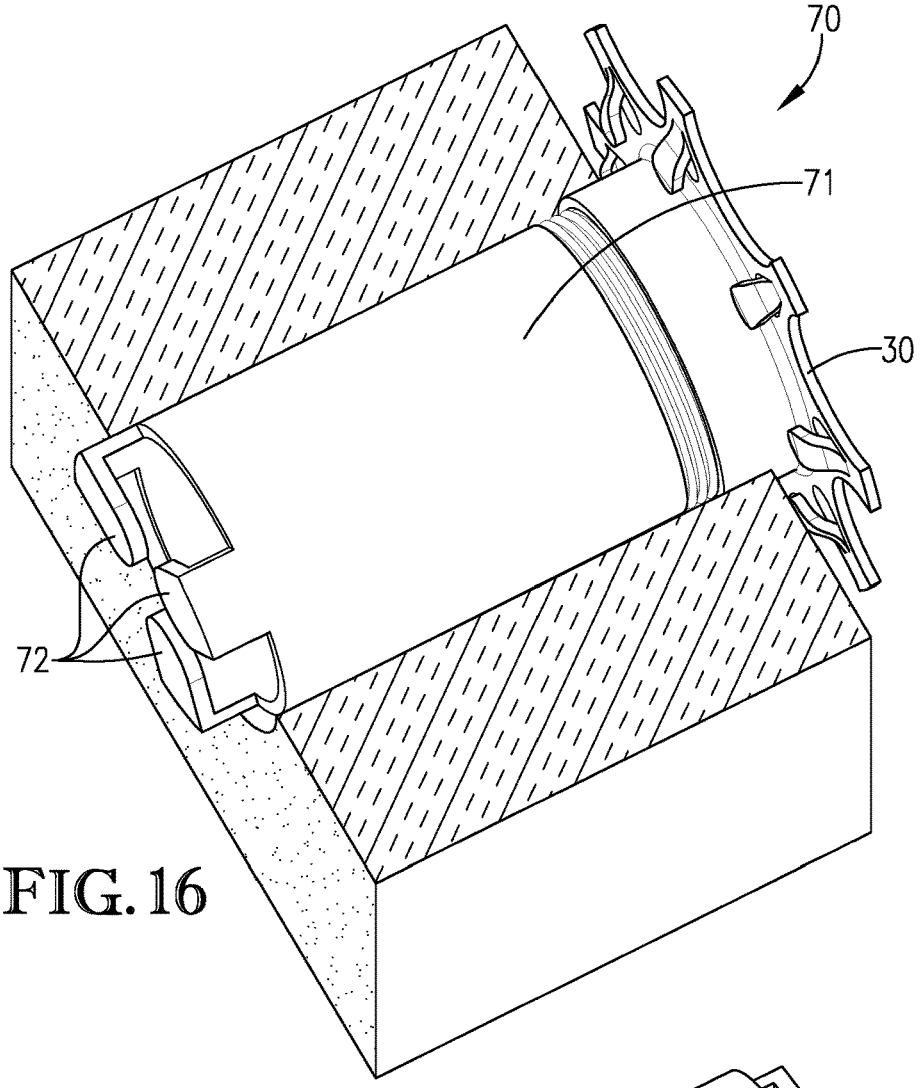
Figure 17:
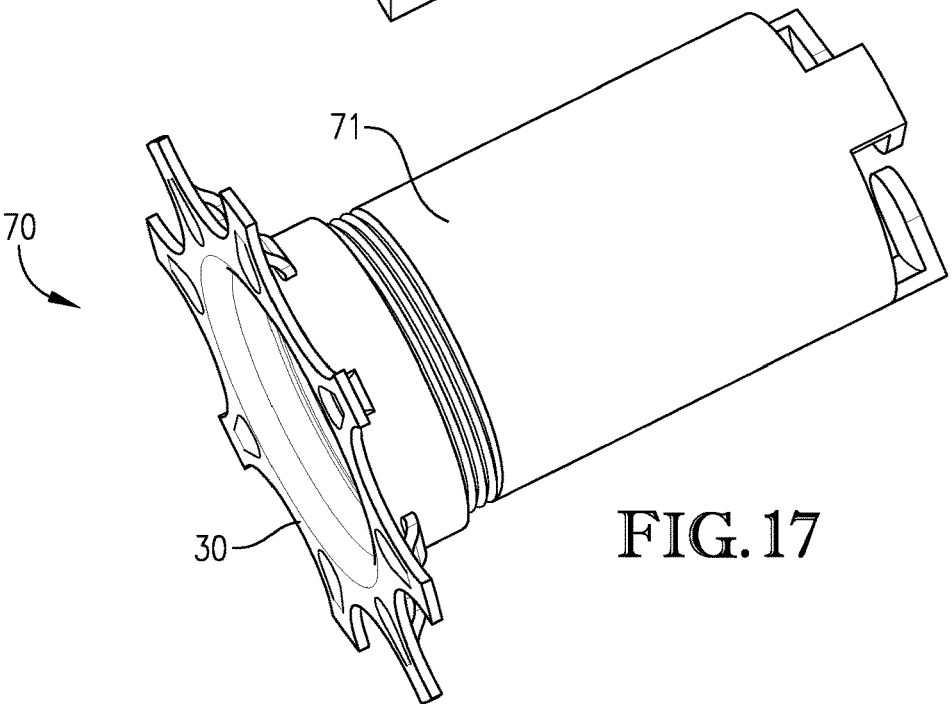
Figure 18:
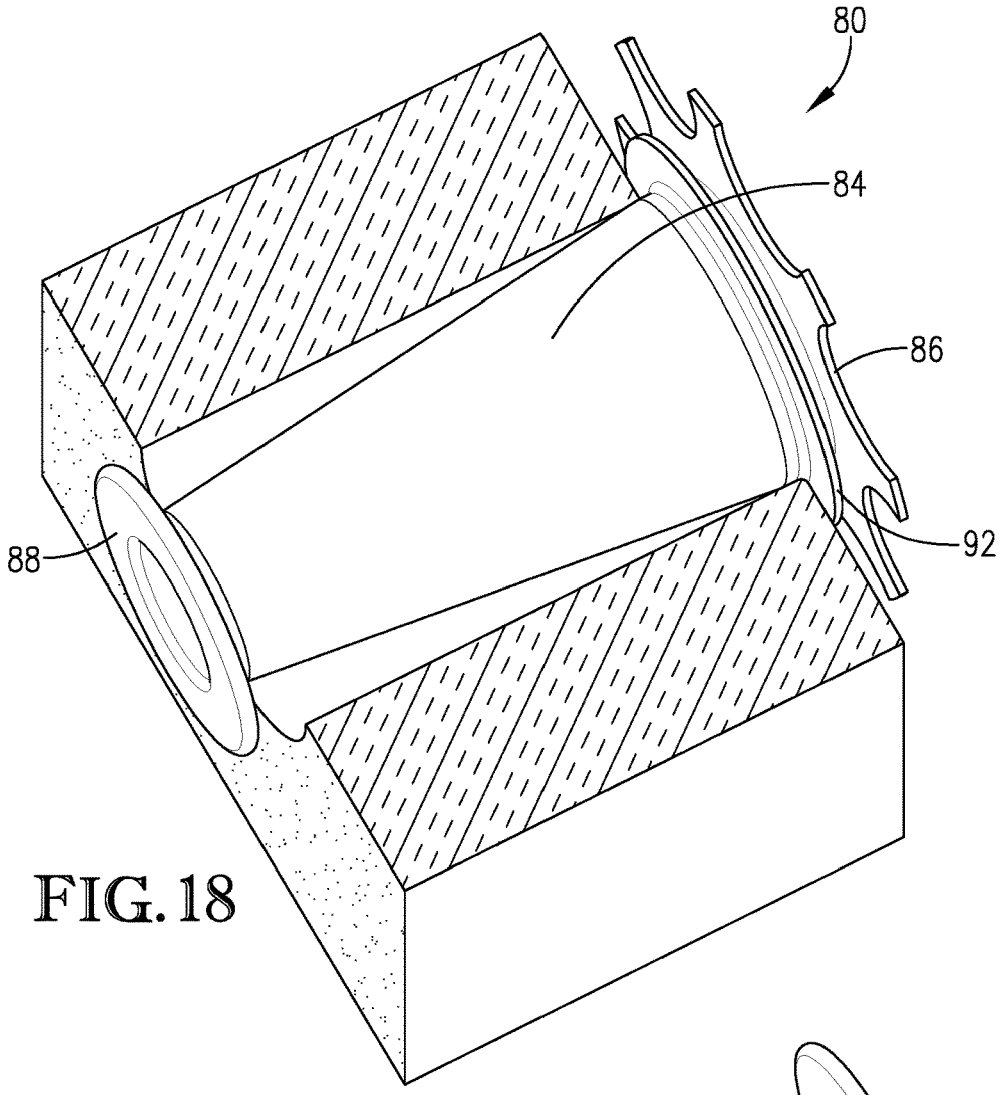
Figure 19:
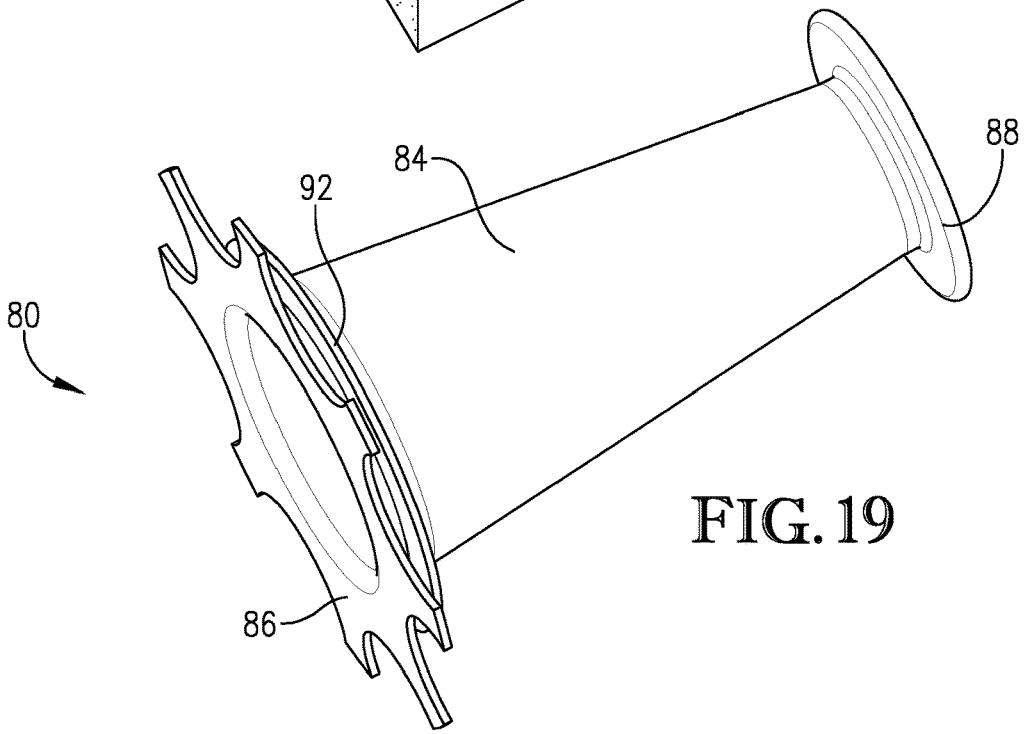
Figure 20:
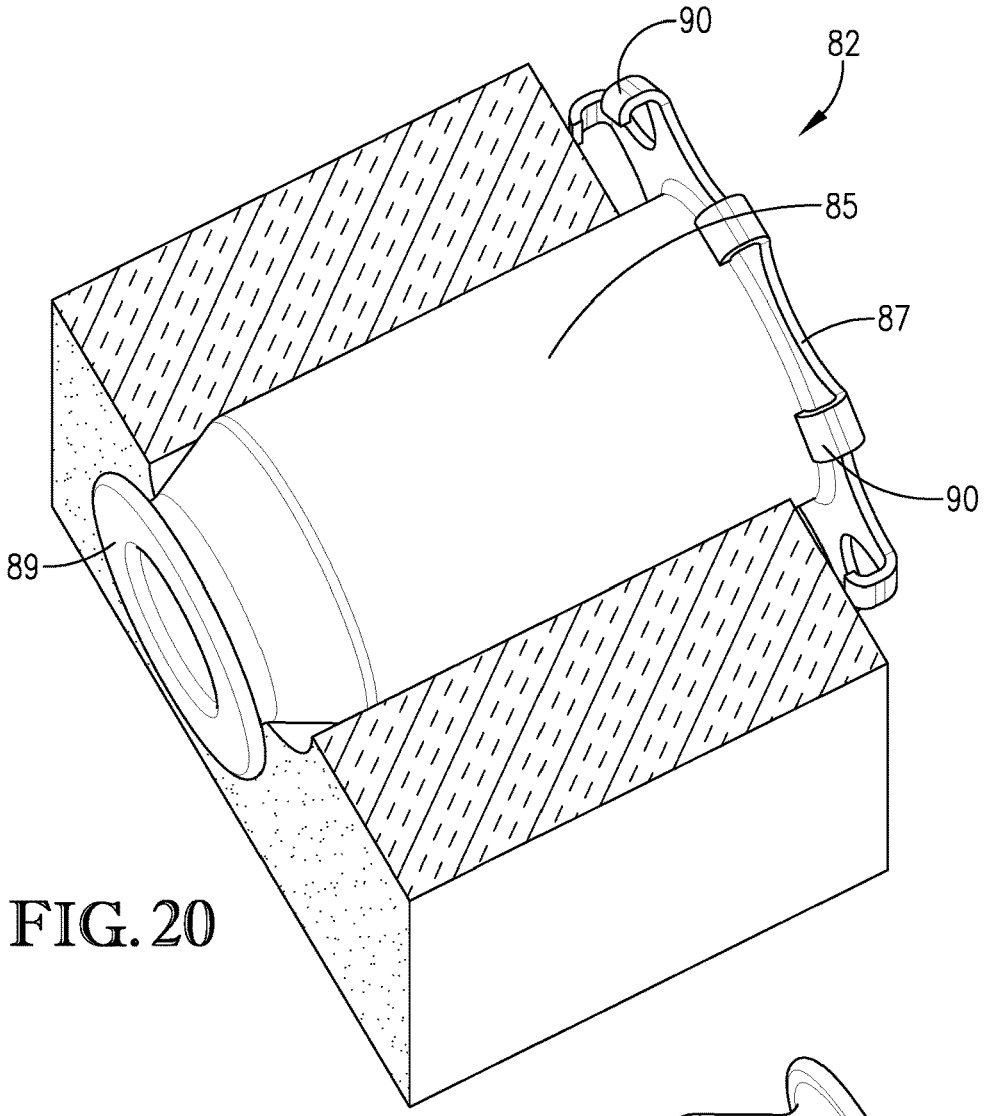
Figure 21:
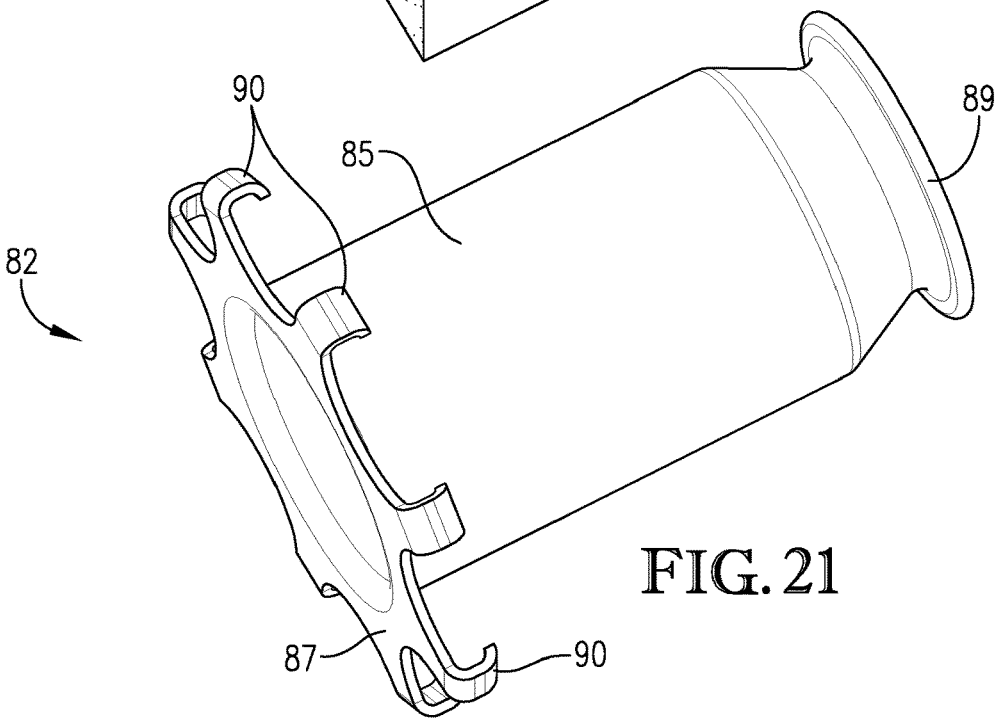
Figure 22:
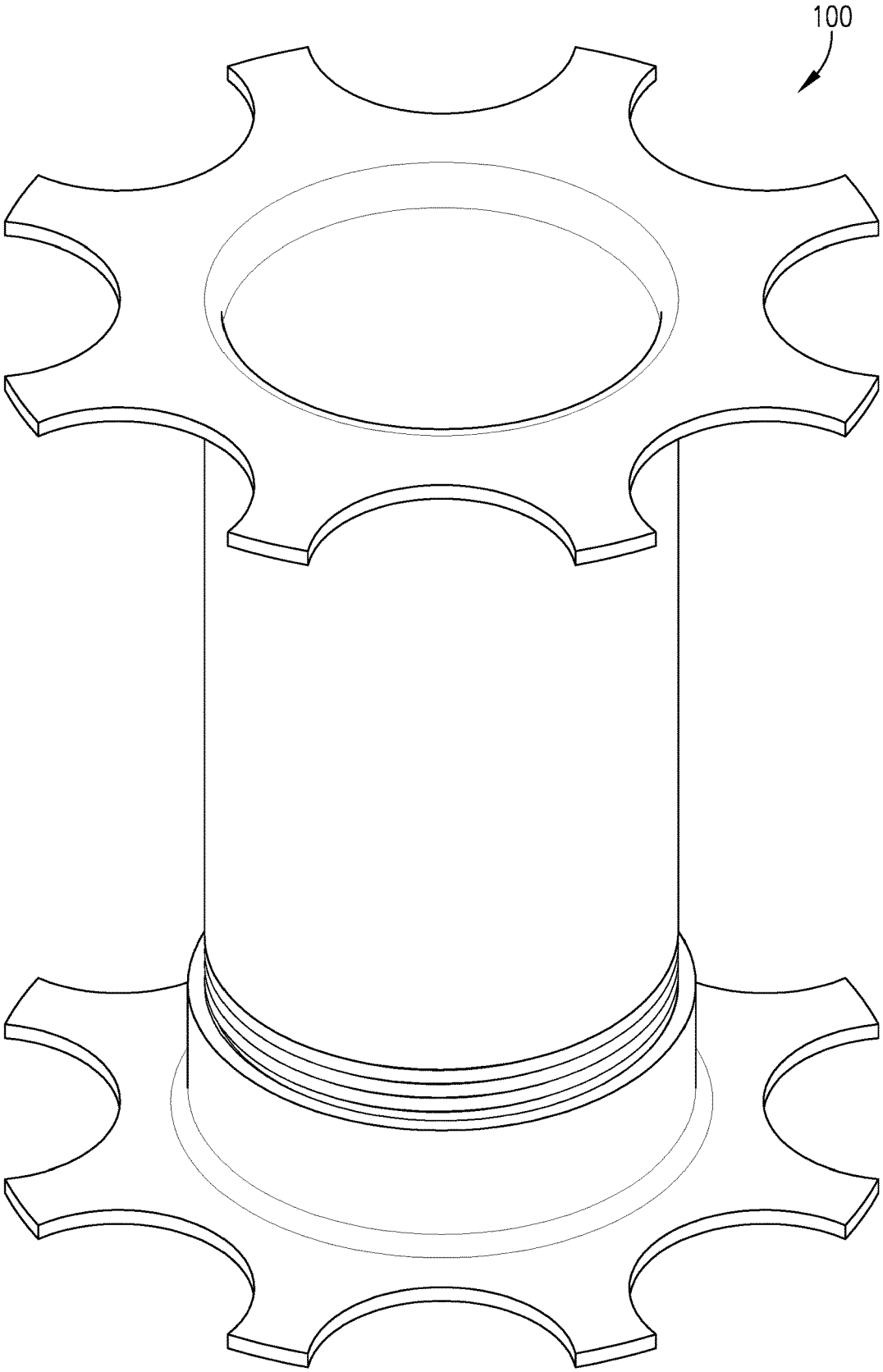

11 is a partial cross-sectional view of a concrete wall panel with the shear connector from FIG. 10 extending therethrough, with a right side of the view being shown with concrete layers sandwiching an insulation layer, and with a left side of the view shown with the concrete layers in phantom;

FIG. 12 is a partial perspective view of an insulated concrete composite wall panel formed according to embodiments of the present invention, particularly illustrating a lifting device formed adjacent to an edge of the wall panel;

FIG. 13 is an enlarged, right-side, cross-sectional view of the wall panel and lifting device from FIG. 12;

FIG. 14 is an elevation view of the lifting device from FIGS. 12-13, particularly shown in reference to a cross-section of a shear connector;

FIG. 15 is a partial left-side cross-sectional view the wall panel from FIG. 12, particularly illustrating the lifting device in relation to a shear connector;

FIG. 16 is perspective partial view of another embodiment of a shear connector formed according to embodiments of the parent invention, with the shear connector being embedded in an insulation layer, and with the insulation layer shown in cross section;

FIG. 17 is an additional perspective view of the shear connector from FIG. 16;

FIG. 18 is a perspective partial view of yet another embodiment of a shear connector formed according to embodiments of the parent invention, with the shear connector being embedded in an insulation layer, and with the insulation layer shown in cross section;

FIG. 19 is an additional perspective view of the shear connector from FIG. 19;

FIG. 20 is a perspective partial view of yet another embodiment of a shear connector formed according to embodiments of the parent invention, with the shear connector being embedded in an insulation layer, and with the insulation layer shown in cross section;

FIG. 21 is an additional perspective view of the shear connector from FIG. 20; and FIG. 22 is another perspective view of a shear connector according to embodiments of the present invention, particularly illustrating a single flanged end-piece threadedly secured to one end of a core member, with another flanged end-piece integrally formed with the other end of the core member.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
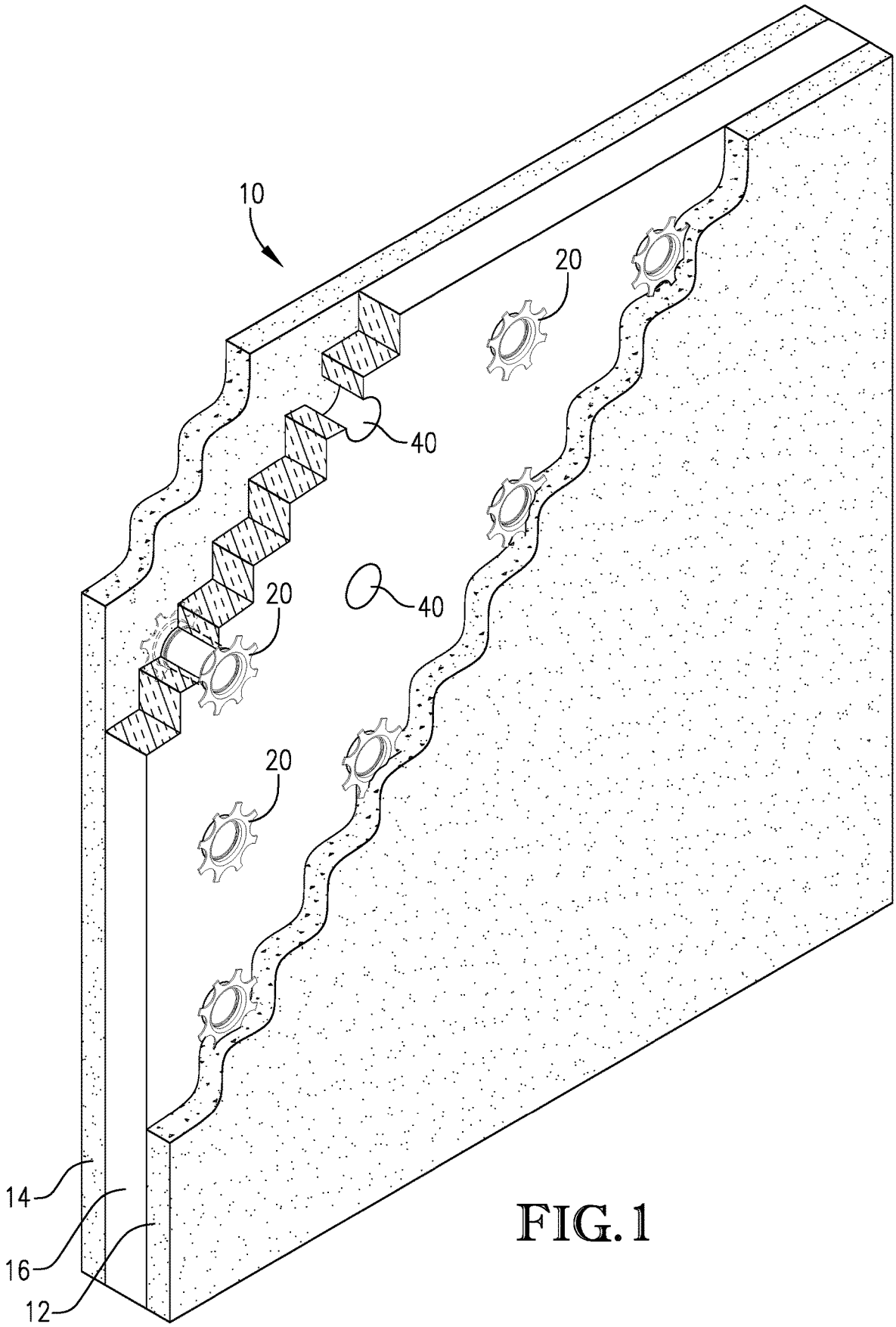
FIG. 1 is a partial perspective view of an insulated concrete composite wall panel formed according to embodiments of the present invention, with the wall panel including a plurality of shear connectors extending therethrough.

As illustrated in FIG. 1, embodiments of the present invention are broadly directed to composite panels, such as composite panel 10 that comprises an inner concrete layer 12 separated from an outer concrete layer 14 by an insulation layer 16. The composite panel 10 is a "composite" panel because it includes one or more shear connectors 20 extending through the insulation layer 16 and engaged within each of the inner and outer concrete layers 12, 14. Specifically, the shear connectors 20 are configured to transfer shear loads between the inner and outer concrete layers 12, 14, thus, providing composite action of the composite panel 10 without delaminating the inner and/or outer concrete layers 12, 14 from the insulation layer 16.

The inner and outer concrete layers 12, 14 may comprise a composite material of aggregate bonded together with fluid cement. Once the cement hardens, the inner and outer concrete layers 12, 14 form rigid wall panels. The inner and outer concrete layers 12, 14 may be formed in various thicknesses, as may be required to satisfy strength and thermal efficiency requirements. For example, the thickness of each of the inner and outer concrete layers 12, 14 may be between 0.25 and 6 inches, between 0.5 and 5 inches, between 2 and 4 inches, or about 3 inches. In some specific embodiments, the inner and outer concrete layers 12, 14 may each be approximately 2 inches, approximately 3 inches, or approximately 4 inches thick.

The insulation layer 16 may comprise a large, rectangular sheet of rigid insulative material. For example, in some embodiments, the insulation layer 16 may comprise expanded or extruded polystyrene board, positioned between the concrete layers. In other embodiments, insulation layers can be formed from expanded polystyrene, phenolic foam, polyisocyanurate, expanded polyethylene, extruded polyethylene, or expanded polypropylene. In even further embodiments, the insulation layer 16 may comprise an open cell foam held within a vacuum bag having the air removed from the bag. In such a vacuum bag embodiment, the insulation layer 16 may be configured to achieve an R value of 48, even with the insulation layer 16 only being two inches thick. Regardless, the insulation layer 16 may be provided in various thicknesses, as may be required to satisfy strength and thermal efficiency requirements. For example, the thickness of the insulation layer 16 may be between 1 and 10 inches, between 2 and 8 inches, or between 5 and 7 inches. In some specific embodiments, the insulation layer 16 may be approximately 2 inches, approximately 3 inches, approximately 4 inches, approximately 5 inches, approximately 6 inches, approximately 7 thick, or approximately 8 inches thick.

Figure 2:
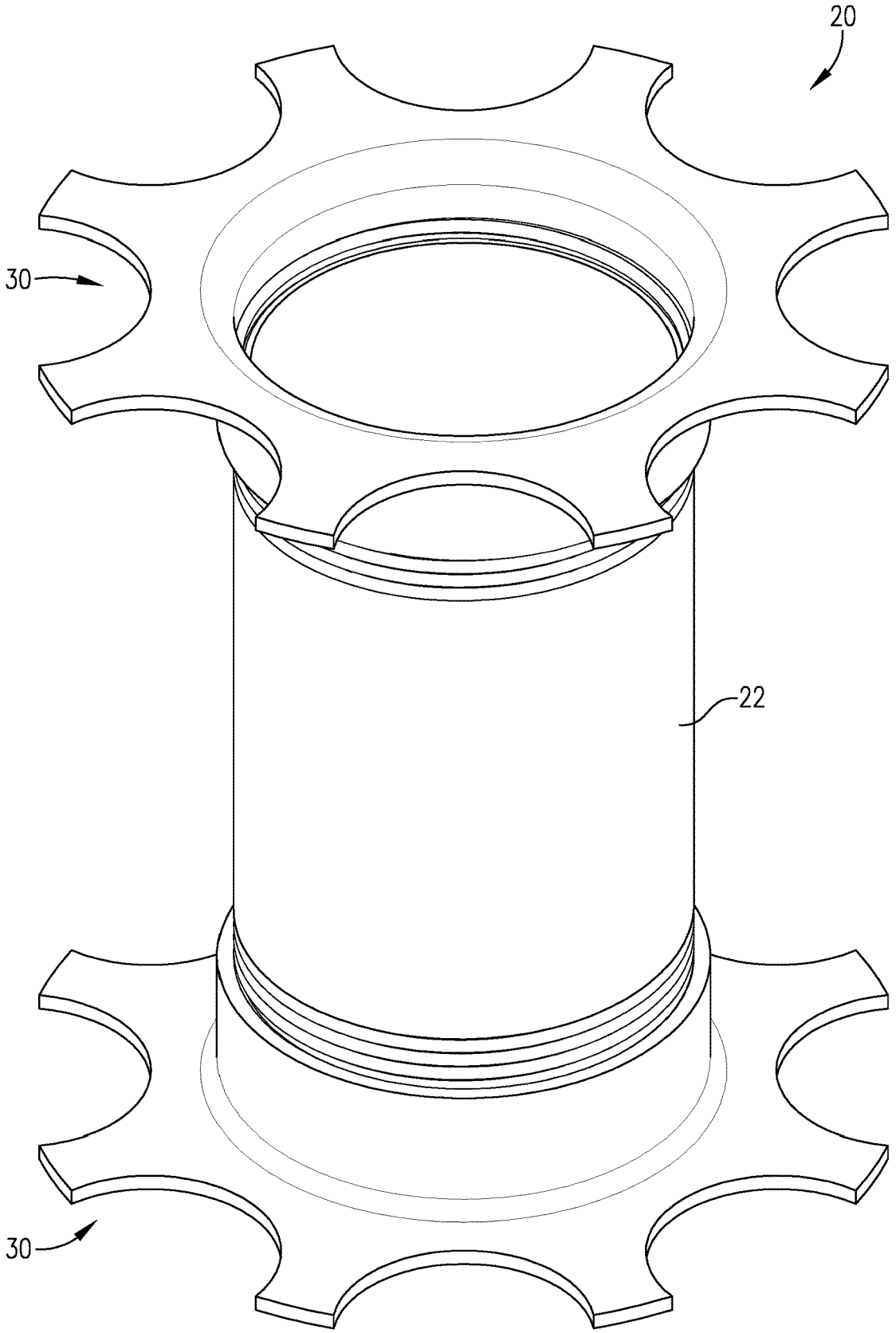
FIG. 2 is a perspective view of a shear connector according to embodiments of the present invention.
Figure 3:
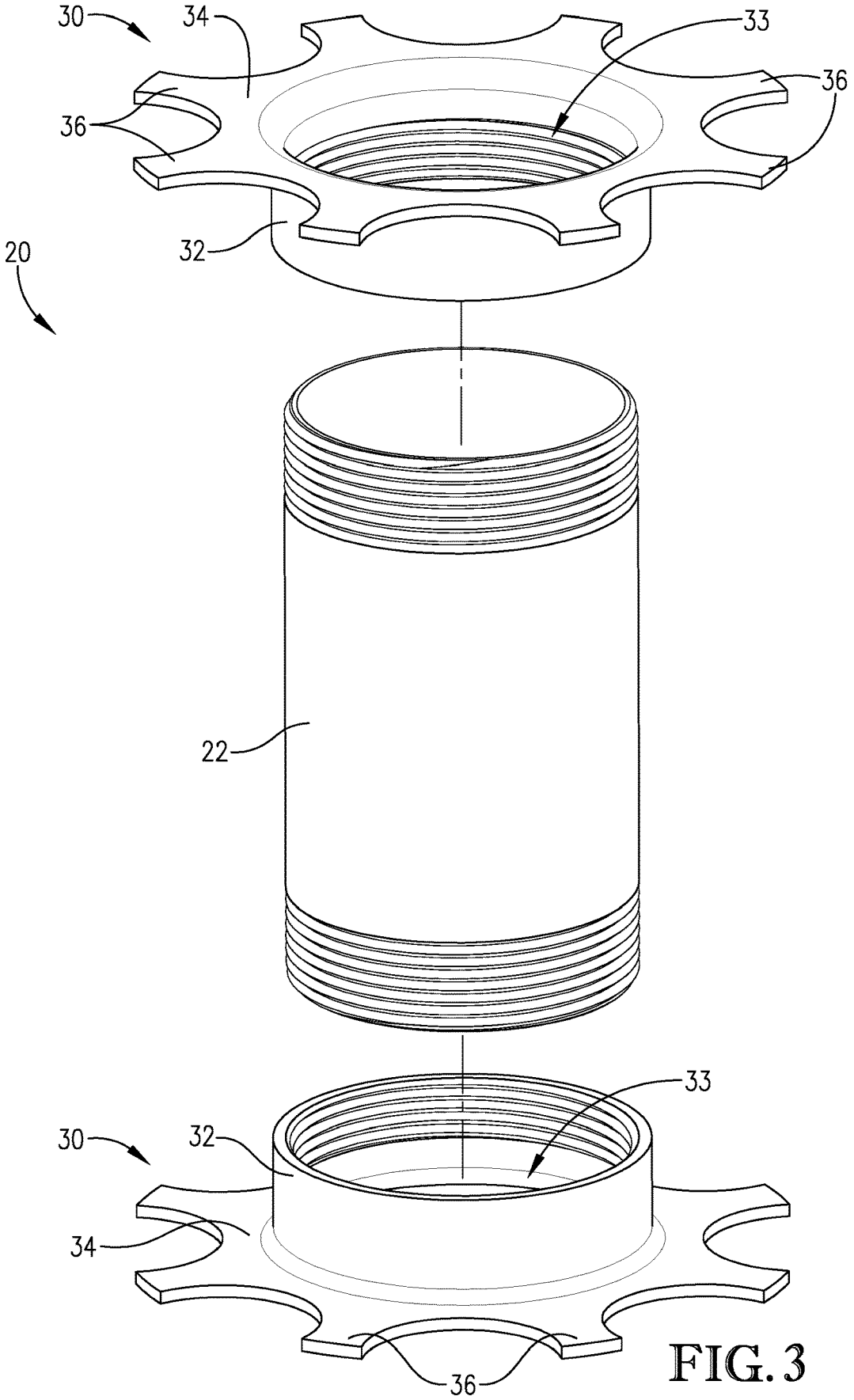
FIG. 3 is an exploded view of the shear connector from FIG. 2.
Figure 4:
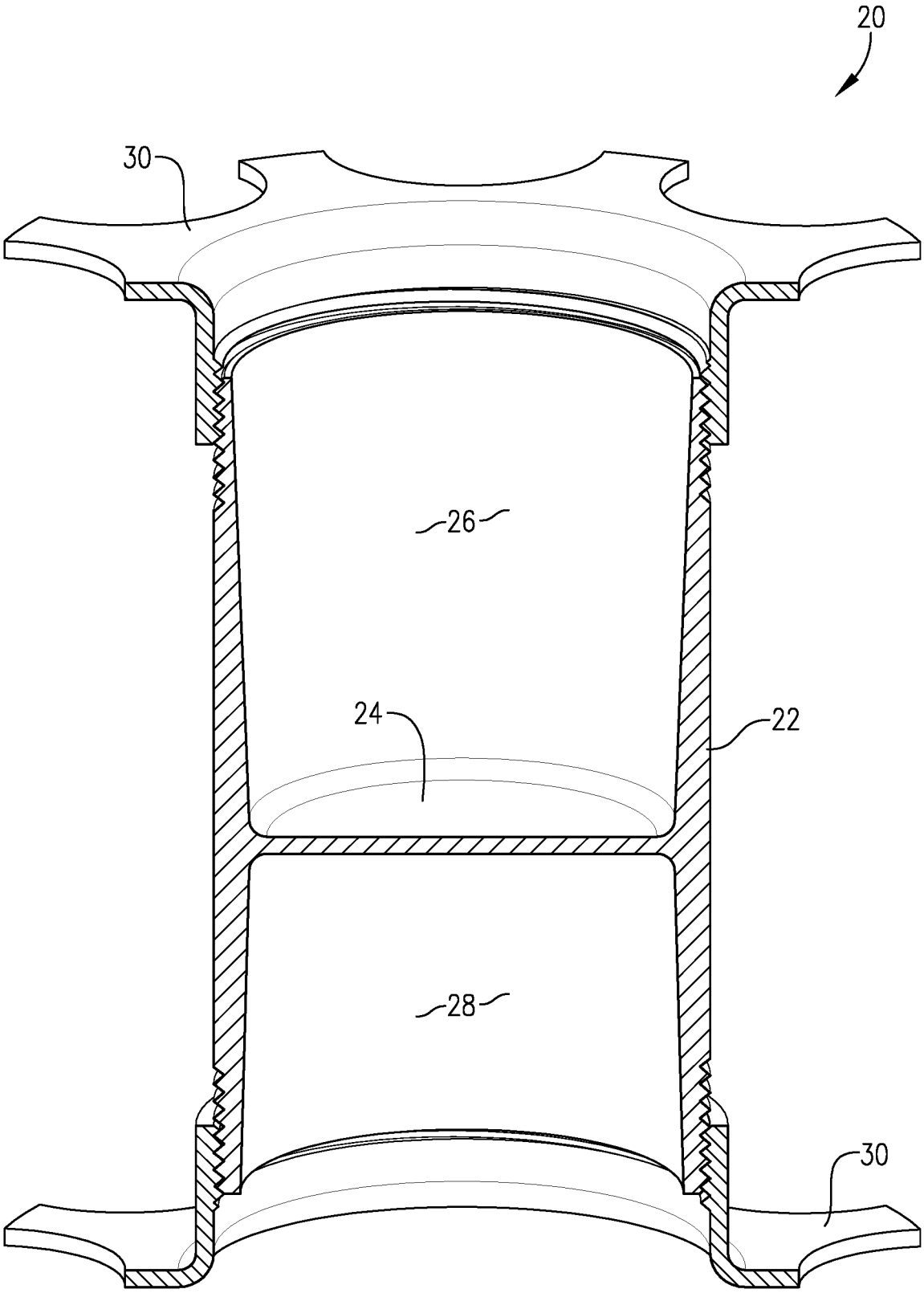
FIG. 4 is a cross-sectional view of the shear connector from FIGS. 2 and 3.

As will be discussed in more detail below, the composite panel 10 of the present invention may formed with the shear connectors 20 by forming holes in the insulation layer 16 and inserting shear connectors 20 within such holes such that the shear connectors 20 can engage with and interconnect the inner and outer concrete layers 12, 14. As illustrated in FIGS. 2-4, the shear connector 20 according to embodiments of the present invention may comprise a generally hollow, cylindrical-shaped core member 22. In other embodiments, the core member 22 may be formed in other shapes, such as cone-shaped, taper-shaped, or the like. The core member 22 may be compression molded, injection molded, extruded, 3D-printed, or the like. The core member 22 may be formed from various thermally insulative materials with sufficient strength and durability to transfer loads between the inner and outer concrete layer 12, 14. For example, in some embodiments, the core member 22 may be formed from polymers, plastics, synthetic resins, epoxies, or the like. In certain embodiments, the core member 22 may be formed to include certain reinforcing elements, such as formed from synthetic resin reinforced with glass or carbon fibers. Nevertheless, in some embodiments, such as when thermal efficiency is not a priority, the core member 22 may be formed from other materials. For example, in such instances, it may be preferable to use a metal (e.g., steel) core member 22 to manufacture lightweight wall panels that are strong/durable and/or that meet a particular fire rating.

The core member 22 may be formed in various sizes so as to be useable with various sizes of insulation layers 16 and/or composite panels 10. For example, the core member 22 may have a length of between 1 and 8 inches, between 2 and 6 inches, or between 3 and 4 inches. In some specific embodiments, the core member 22 may have a length of approximately 2 inches, approximately 3 inches, approximately 4 inches, approximately 5 inches, approximately 6 inches, approximately 7 inches, or approximately 8 inches. As illustrated in FIGS. 2-4, the core member 22 may comprise a substantially hollow cylinder such that the core member 22 presents an outer diameter and an inner diameter. In such embodiments, the outer diameter (or the maximum diameter) of the core member 22 may be between 1 to 10 inches, between 2 to 8 inches, between 3 to 6 inches, or between 3 to 4 inches. As such, a ratio of the length of the core member 22 to the maximum diameter of the core member 22 may be between 1:1 to 3:1, between 1.5:1 to 2.5:1, or about 2:1. The core member 22 may have a thickness (as measured from the outer diameter to the inner diameter) of between 0.1 to 0.75 inches, between 0.25 to 0.5 inches, or about 0.33 inches. The inner diameter of the core member 22 may extend approximately the same dimension as the outer diameter less the thickness of the core member 22. For example, the inner diameter of the core member 22 may be between 1 to 10 inches, between 2 to 8 inches, between 3 to 6 inches, or between 3 to 4 inches, or about 3.5 inches.

In certain embodiments, as illustrated in FIG. 4, the core member 22 may include a separation plate 24 that extends across an interior space of the core member 22. Specifically, the separation plate 24 may be orientated generally perpendicularly with respect to a longitudinal extension direction of the core member 22 and may extend across the entire inner diameter of the core member 22. The separation plate 24 may be formed as a solid, circular piece of material, which may be the same material from which the core member 22 is formed. The separation plate 24 may, in some embodiments, be positioned generally midway about the length of the core member 22 (i.e., near a center of the core member 22), so as to separate the interior space of the core member 22 into an inner chamber 26 and an outer chamber 28. Nevertheless, in other embodiments, the separation plate 24 may be offset from the center of the core member's 22 length.

Figure 5:
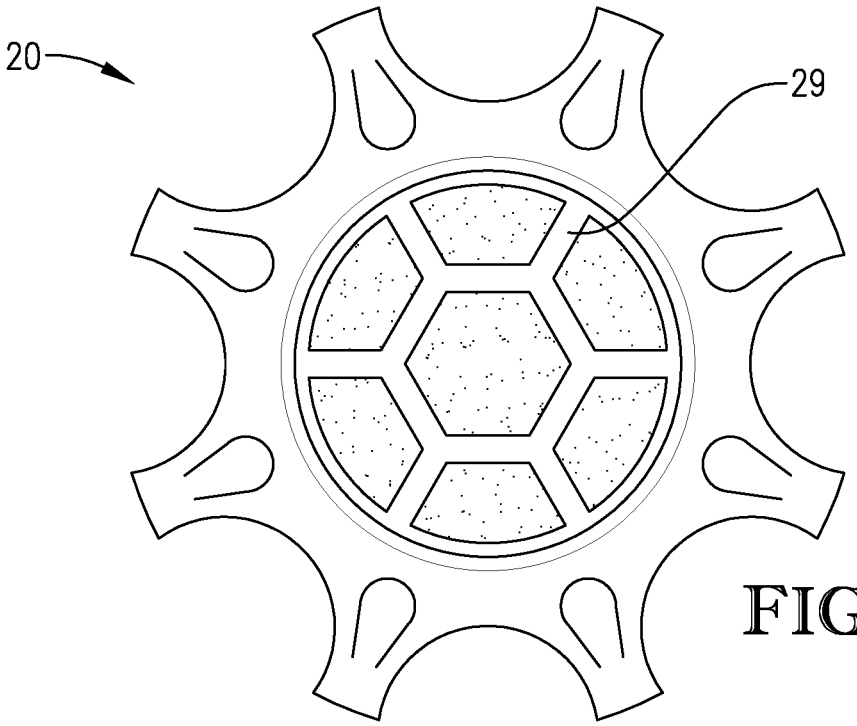
FIG. 5 is a top plan view of a shear connector with a reinforcing web.
Figure 6:
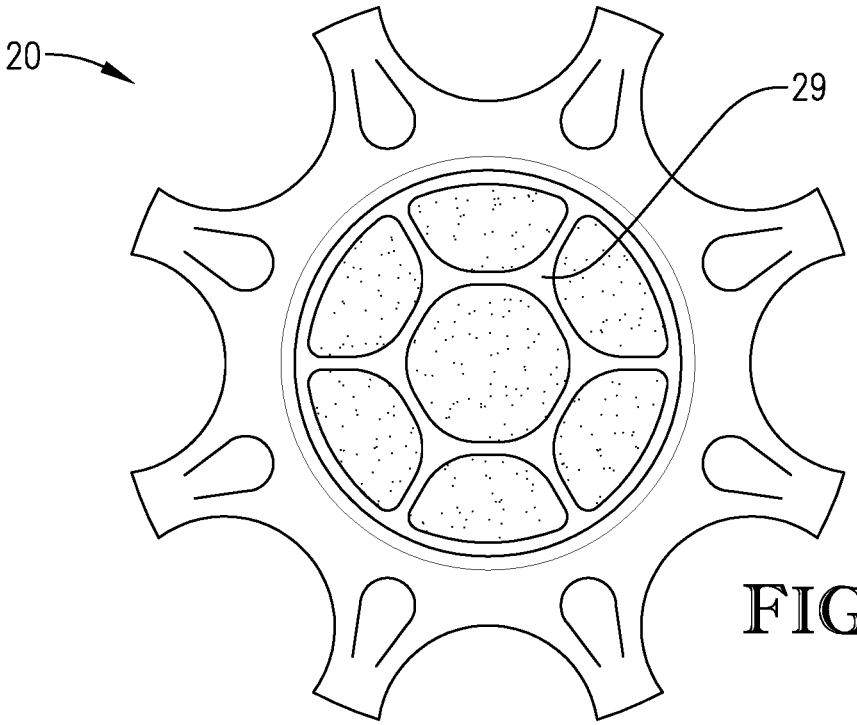
FIG. 6 is a top plan view of another embodiment of a shear connector with a reinforcing web.

In certain embodiments, as illustrated in FIGS. 5 and 6, one or both sides of the separation plate 24 may be formed with a reinforcing section of material, such as a reinforcing web 29 that extends (1) upward and/or downward from the separation plate 24 into the inner chamber 26 and/or outer chamber 28, and/or (2) outward from the interior surface of the core member 22 through a portion of the inner chamber 26 and/or outer chamber 28. As shown in FIG. 5, the reinforcing web 29 may be in the form of a honeycomb-shaped structure that extends across the interior space of the core member 22 (e.g., contacting the interior surface of the core member 22 at multiple locations). In other embodiments, such as shown in FIG. 6, the reinforcing web 29 may be in the form of multiple interconnected, arcuate-shaped structures that extend across the interior space of the core member 22 (e.g., contacting the interior surface of the core member 22 at multiple locations). The reinforcing web 29 may be formed form the same material as the core member 22 and may be configured to increase the structural integrity of the shear connector 20 by enhancing the load-carrying capacity of the shear connector 20. Specifically, for instance, the honeycomb-shaped reinforcing web 29 may be configured to reinforce the shear connector 20 in multiple directions, so as to provide for the shear connector 20 to have consistent load-carrying properties in multiple directions (e.g., −x, −y, and/or −z directions). In certain embodiments, thermal properties of the shear connector 20 may also be enhanced by the use of an expansive foam or other insulating material used on the inside of the shear connector 20 (e.g., within the inner the inner chamber 26 and/or outer chamber 28) or between the elements of the reinforcing web 29, as applicable. As noted above, in certain embodiments, only one of the inner chamber 26 or outer chamber 28 may include the reinforcing web 29. For example, in some embodiments, as will be described in more detail below, the inner chamber 26 may be filled within concrete when forming the inner concrete layer 12. As such, it may be preferable for the inner chamber 26 to not include the reinforcing web 29 to permit the concrete to flow freely within the inner chamber 26, and for the outer chamber 28 to include the reinforcing web 29 to provide additional support and integrity for the shear connector 20.

Returning to FIG. 2-4, in certain embodiments, the shear connector 20 may also include flanged end-pieces 30 connected to each end of the core member 22. In some embodiments, the flanged end-pieces 30 may be formed (e.g., compression molded, injection molded, extruded, 3D-printed) from the same material from which the core member 22 is formed (e.g., thermally insulative resins). In other embodiments, the flanged end-pieces 30 may be formed from metals, such as stainless steel, or other materials with sufficient strength to pass loads to the core member 22 when the flanged end-pieces are connected with the core member 22.

Certain embodiments of the present invention provide for the ends of the core member 22 to be threaded, and for the flanged end-pieces 30 to be correspondingly threaded. As such, a flanged end-piece 30 may be threadedly secured to each end of the core member 22. In some embodiments, as shown in FIG. 3, the threaded portion of the core member 22 may be on an exterior surface of the core member 22 and the threaded portion of the flanged end-pieces 30 may be on an interior surface of the flanged end-pieces 30, such that the flanged end-pieces 30 may be threadedly secured to the exterior surface of the core member 22. In some alternative embodiments, the threaded portion of the core member 22 may be on an interior surface of the core member 22 and the threaded portion of the flanged end-pieces 30 may be on an exterior surface of the flanged end-pieces 30, such that the flanged end-pieces 30 may be threadedly secured to the interior surface of the core member 22. In addition to the threaded components, other embodiments of the present invention may provide for the flanged end-pieces 30 to be secured to the core member 22 via other methods of attachment, such as by adhesives (e.g., glue, concrete from the composite panel 10, etc.), fasteners (e.g., screws), or the like.

Other embodiments of the shear connector 20 may provide for one or both of the flanged end-pieces 30 to be permanently secured to the core member 22. For example, in some embodiments, one of the flanged end-pieces 30 of a shear connector 20 may be permanently attached to one end of the core member 22, such that only the other, opposite flanged end-piece 30 is configured to be removably connected (e.g., via threaded connections) to the other end of the core member 22. In still other embodiments, both of the flanged end-pieces 30 of the shear connector 20 may be permanently secured to the ends of the shear connector 20.

Turning to the structure of the flanged end-pieces 30 in more detail, as perhaps best illustrated by FIG. 3, the flanged end-pieces 30 may each comprise a cylindrical base section 32. In some embodiments, the base section 32 may be a hollow cylinder with an outer diameter and an inner diameter that presents a central opening 33. When the flanged end-pieces 30 are threaded on the core members 22, the flanged end-pieces 30 may be axially aligned with the core member 22 such that the central openings 33 of the base section 32 are in fluid communication with either the inner chamber 26 or the outer chamber 28. In embodiments in which the exterior surface of the core member 22 includes the threaded portions, the inner diameter of the base section 32 may correspond with the exterior diameter of the core member 22 so as to facilitate the threaded connection of the flanged end-pieces 30 with the core member 22. In embodiments in which the interior surface of the core member 22 includes the threaded portions, the outer diameter of the base section 32 may correspond with the interior diameter of the core member 22 so as to facilitate the threaded connection of the flanged end-pieces 30 with the core member 22. In some specific embodiments, the base section 32 may have a height between 0.5 to 5 inches, between 1 and 4 inches, between 2 and 3 inches, or about 2.5 inches.

Remaining with FIG. 3, the flanged end-pieces 30 may also include a flange section 34 that extends radially from the base section 32. In some embodiments, the flange section 34 may extend generally perpendicularly with respect to the base section 32. The flanged end-pieces 30 may have maximum diameters (extending across the flange section 34) of between 3 to 12 inches, between 4 to 16 inches, between 5 to 8 inches, or about 6.75 inches. Regardless, as illustrated in the drawings, a maximum diameter of the flanged end-pieces 30 will be greater than a maximum diameter of the core member 22 and/or of the holes formed in the insulation layer 16. For example, a ratio of the maximum diameter of the flanged-end pieces 30 to the maximum diameter of the core member 22 may be between 1.5:1 to 3:1, between 1.75:1 to 2.75:1, between 2.0:1 to 2.5:1, between 2.0:1 to 2.25:1, or about 2:1. As will be discussed in more detail blow, such maximum diameter permits the shear connector to be maintained in an appropriate position within an opening formed in the insulation layer 16.

Figure 7:
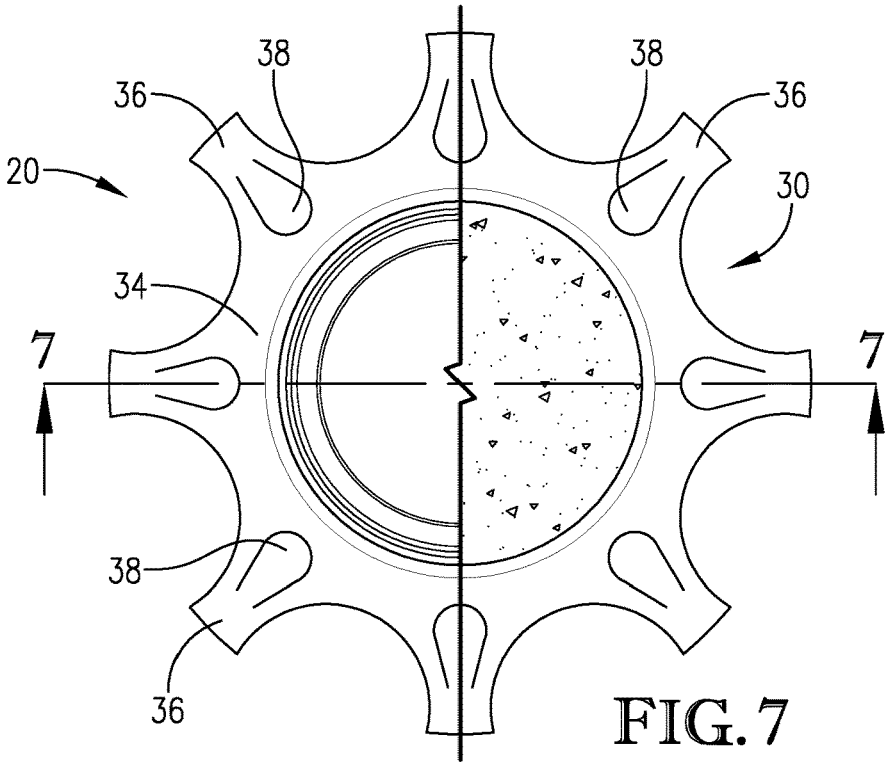
FIG. 7 is a top plan view of a shear connector, particularly illustrating a portion of the shear connector being filled within concrete.
Figure 8:
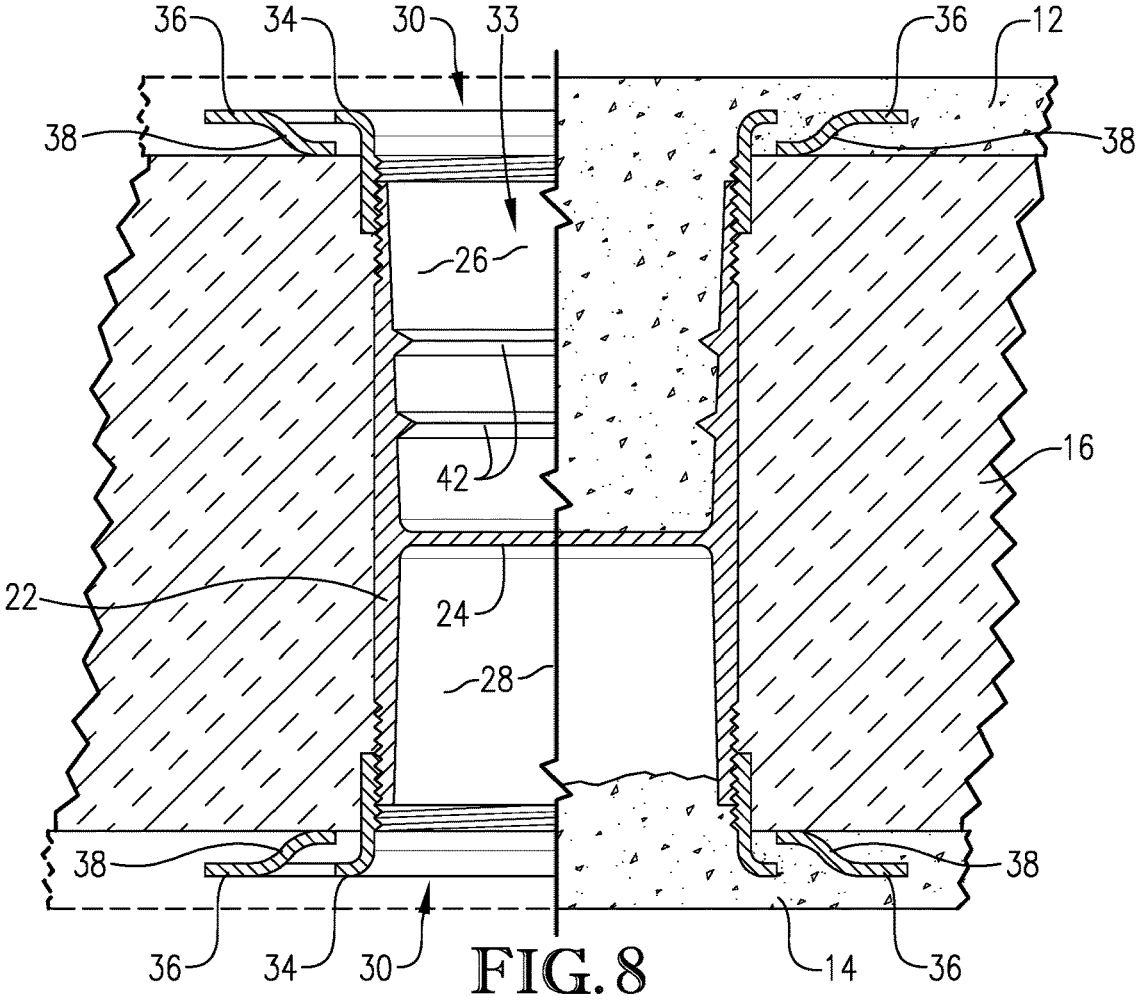
FIG. 8 is a partial cross-sectional view of a concrete wall panel with the shear connector from FIG. 7 extending therethrough, with a right side of the view being shown with concrete layers sandwiching an insulation layer, and with a left side of the view shown with the concrete layers in phantom.

In certain embodiments, the flange section 34 may be generally circular. However, in some embodiments, the flange section 34 may include a plurality of radially-extending projections 36 positioned circumferentially about the flange section 34. In addition, as shown in FIGS. 7 and 8, the flanged end-pieces 30 may include a plurality of tabs 38 that extend from below the flange section 34. In certain embodiments, the tabs 38 may extend from below each of the projections 36. The tabs may extend downward from the projections 36 between 0.25 and 3 inches, between 0.5 and 2 inches, or about 1 inches. In certain embodiments, the tabs 38 may be punched out from the projections 36. In such embodiments, that the tabs 38 originally formed part of the projections 36. Specifically, a tab-shaped section can be cut into the projection 36 (while a portion of the tab-shaped section remains secured to the projection 36), such that the tab 38 can be punched out, in a downward direction, away from the projection 36.

Given the shear connector 20 described above, a composite panel 10 can be manufactured. In particular, with reference to FIG. 1, manufacture of a composite panel 10 can begin by starting with a section of insulation that will form the insulation layer 16. Generally, the insulation layer 16 will be rectangular, although it may be formed in other required shapes. A plurality of substantially-circular connector openings 40 may be formed through the insulation layer 16. Such connector openings 40 may be formed using a hand/electric/pneumatic drill with a core bit. The connector openings 40 may be formed having a diameter that corresponds with the outer diameter of the core member 22 of the shear connector 20, such that core members 22 can be inserted into the connector openings 40.

Figure 9:
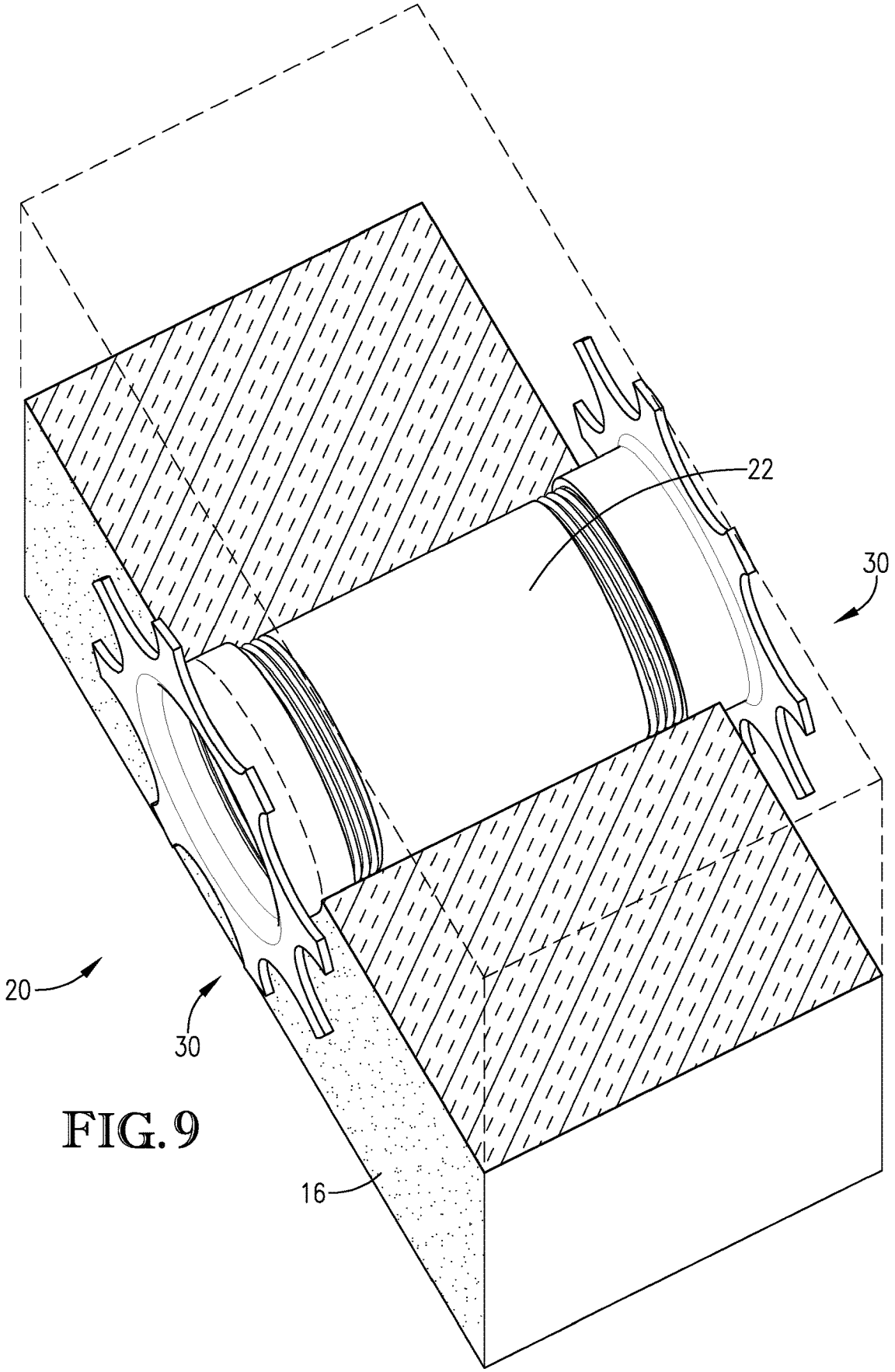
FIG. 9 is a partial view of a section of insulation with a shear connector received therein.

Turning to FIGS. 7 and 9, upon a core member 22 being inserted into a connector opening 40, a flanged end-piece 30 can be secured to each end of each of the core members 22. In some embodiments, one of the flanged end-pieces may be secured to an end of the core member 22 prior to the core member 22 being inserted within an opening 40 of the insulation layer 16. Nevertheless, once the core member 22 has been inserted within the insulation layer 16, the flanged end-pieces 30 should each be threaded onto the end of a core member 22 until the tabs 38 (tabs 38 not shown in FIG. 9) contact an exterior surface of the insulation layer 16, as shown in FIG. 8. As such, the flange sections 34 of the flanged end-pieces 30 are spaced apart from the exterior surface of the insulation layer 16. Beneficially, the threaded portions of the core members 22 and/or the flanged end-pieces 30 permit the flanged end-pieces 30 to be secured at different extension levels onto the core members 22 (i.e., closer to or farther from a center of the core member 22). As such, the shear connector 20 can be made shorter or longer, so as to be usable with insulation layers 16 of various thicknesses by threadedly adjusting the position of the flanged end-pieces 30 with respect to the core member 22. For example, for a thinner insulation layer 16, a flanged end-piece 30 can be threaded significantly downward onto the core member 22 until the tabs 38 contact the exterior surface of the insulation layer 16. In contrast, for a thicker insulation layer, a flanged end-piece 30 may be threaded downward a relatively lesser amount onto the core member 22 until the tabs 38 contact the exterior surface of the insulation layer 16.

Turning back to FIG. 1, with a shear connector 20 inserted within one or more (or each) connector openings 40 of the insulation layer 16 the composite panel 10 can be created by forming the inner and outer concrete layers 12, 14. To begin, the outer concrete layer 14 can be formed by pouring concrete into a concrete form. Immediately following pouring the outer concrete layer 14, the insulation layer 16 with the shear connectors 20 inserted therein can be lowered into engagement with the outer concrete layer 14. As illustrated in FIG. 8, the flange sections 34 of the flanged end-pieces 30 that extend down from a outer exterior surface of the insulation layer 16 become inserted into and embedded in the outer concrete layer 14. Beneficially, the shape of the flanged end-pieces 30 (e.g., the space between the exterior surface of the insulation layer 16 and the flange section 34, the projections 36, and the central opening 33) is configured to securely engage the outer concrete layer 14 so as to facilitate transfer of loads from/to the outer concrete layer 14 to/from the shear connector 20. Reinforcement in the form of rebar (e.g., iron, steel, etc.), steel mesh, or prestress strand may also be inserted into the outer concrete layer 14. Furthermore, the concrete used in the formation of the outer concrete layer 14 may, in some embodiments, incorporate the use of high performance or ultra-high performance concrete that includes reinforcing fibers of glass, carbon, steel, stainless steel, polypropylene, or the like, so as to provide additional tensile and compressive strength to the composite panel 10. For example, a plurality of glass fiber rebars (e.g., 20-40 fiber rebars) may be bundled and held together by epoxy. Such bundles of glass fiber rebar may be added to the concrete to provide strength to the concrete.

Subsequent to placing the insulation layer 16 and the shear connectors 20 on and/or into the outer concrete layer 14, the inner concrete layer 12 can be poured onto an inner exterior surface of the insulation layer 16. As illustrated in FIG. 8, when the inner concrete layer 12 is poured, flange sections 34 of the flanged end-pieces 30 that extend up from the exterior surface of the insulation layer 16 become embedded within the inner concrete layer 12. Beneficially, the shape of the flanged end-pieces 30 (e.g., the space between the exterior surface of the insulation layer 16 and the flange section 34, the projections 36, and the central opening 33) is configured to securely engage the inner concrete layer 12 so as to facilitate transfer of loads from/to the inner concrete layer 12 to/from the shear connector 20. Reinforcement in the form of rebar, steel mesh, or prestress strand may also be inserted into the inner concrete layer 12. Furthermore, the concrete used in the formation of the inner concrete layer 12 may, in some embodiments, incorporate the use of high performance or ultra-high performance concrete that includes reinforcing fibers of glass, carbon, steel, stainless steel, polypropylene, or the like, so as to provide additional tensile and compressive strength to the composite panel 10. For example, a plurality of glass fiber rebars (e.g., 20-40 fiber rebars) may be bundled and held together by epoxy. Such bundles of glass fiber rebar may be added to the concrete to provide strength to the concrete.

Furthermore, during the pouring of the inner concrete layer 12, as illustrated in FIG. 8, concrete may flow through the central opening 33 of the flanged end-piece 30 and into the inner chamber 26 of the core member 22. However, the separation plate 24 prevents the concrete from flowing down into the outer chamber 28 of the core member 22. As such, an air pocket may be created within the outer chamber 28, with such air pocket facilitating thermal insulation between the inner and outer concrete layers 12, 14. As an additional benefit, partially filling the shear connector 20 with concrete may enhance the load-carrying capacity of the shear connector 20. In some embodiments, the concrete-filled inner chamber 26 may include one or more protruding elements 42 that extend from the interior surface of the core member 22 so as to facilitate engagement of the shear connector 20 with the concrete. It should be understood that in some embodiments, concrete from the outer concrete layer 14 may flow into the outer chamber 28, such that it may be beneficial for the outer chamber 28 to also include protruding elements 42 that facilitate the shear connector's 20 engagement with the concrete. Similarly, in some embodiments of the shear connectors 20 that include the reinforcing web 29, the components of the reinforcing web 29 may be used to facilitate engagement of the shear connector 20 with the concrete. Furthermore, as described above, the concrete used in the formation of the inner and outer concrete layers 12, 14 may, in some embodiments, incorporate the use of high performance or ultra-high performance concrete that include reinforcing fibers of glass, steel, stainless steel, polypropylene, or the like, so as to provide additional tensile and compressive strength to the composite panel 10.

Figure 11:
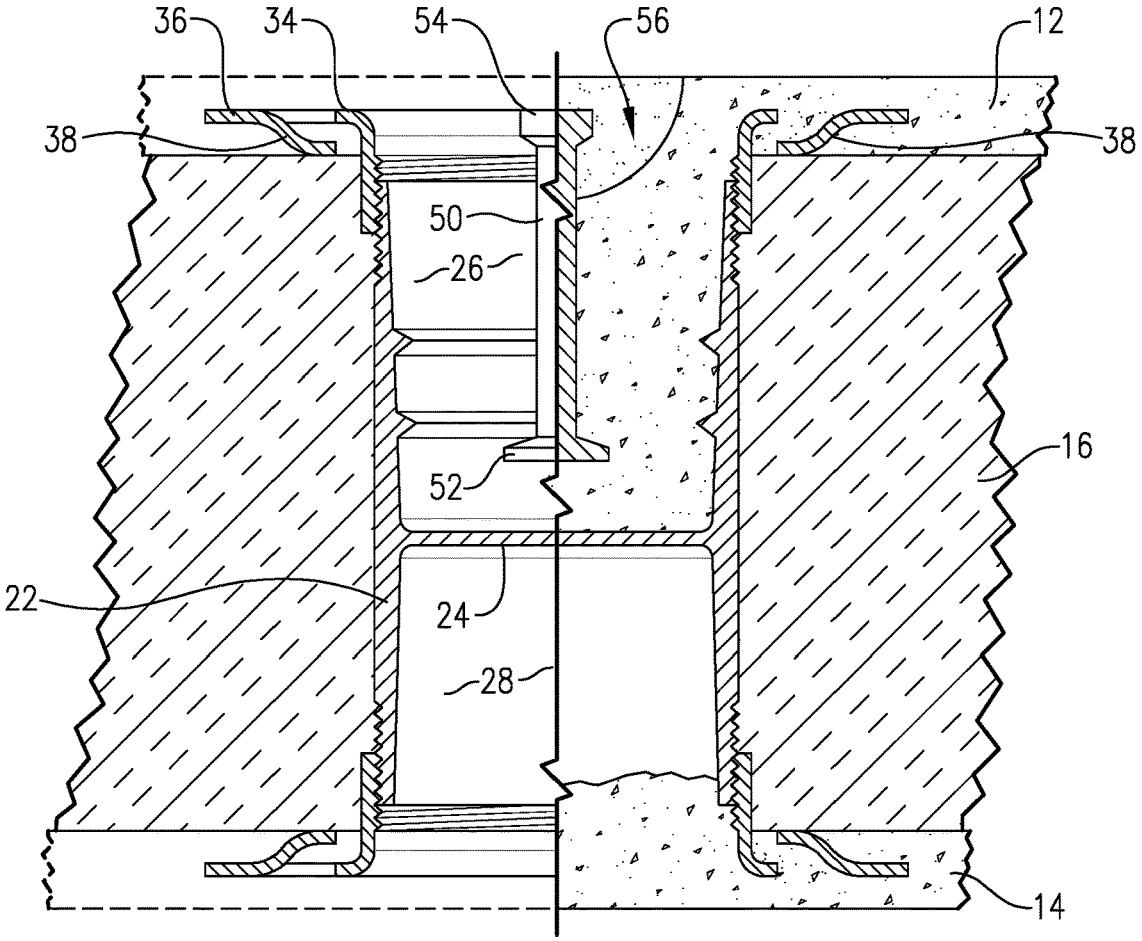

As described above, the composite panel 10 may be formed in a generally horizontal orientation. To be used as wall for a building structure, the composite panel 10 is generally tilted upward to a vertical orientation. To facilitate such movement of the composite panel 10, embodiments of the present invention may incorporate the use of a lifting device to assist in the tilting of the composite panel 10. In some embodiments, as shown in FIGS. 10 and 11 the lifting device may be in the form of a handle rod 50 (otherwise known as a "dog bone"). The handle rod 50 may comprise a generally elongated rod of iron, stainless steel, or other sufficiently-strong metal. As shown in FIG. 11, the handle rod 50 may include a flared bottom end 52 and a flared top end 54. Upon the pouring of the inner concrete layer 12, the handle rod 50 may be inserted within the inner concrete layer 12 near an edge of the composite panel 10. The handle rod 50 may be inserted within the inner concrete layer 12 that is poured in an opening formed through a portion of the insulation layer 16, or may, as illustrated in FIGS. 10 and 11 (and as described in more detail below), be inserted within concrete from the inner concrete layer 12 that is filled within that inner chamber 26 of the shear connector 20. Regardless, the inner concrete layer 12 can harden or cure with the handle rod 50 embedded therein. In some specific embodiments, the handle rod 50 will be embedded within the inner concrete layer 12 to an extent that permits the top end 54 to extend out from the inner concrete layer 12. For instance, the bottom end 52 and a significant portion of a body of the handle rod 50 may be embedded within the inner concrete layer 12, while the top end 54 extends from the concrete. Beneficially, the flared shape of the bottom end 52 enhances the ability of the handle rod 50 to be engaged with the inner concrete 12. However, as noted above, the top end 54 of the handle rod 50 may be exposed so that it can be grasped to lift the composite panel 10, as will be discussed in more detail below.

As illustrated in FIGS. 10 and 11, the top end 54 of the handle rod 50 may be positioned below an outer surface of the inner concrete layer 12; however, in some embodiments, a recess 56 may be formed within a portion of the inner concrete layer 12 around the top end 54 of the handle rod 50, so as to expose the top end 54. With the top end 54 of the handle rod 50 exposed, a grasping hook (not shown) or a "dog bone brace connector" can be engaged with the top end 54 of the handle rod 50 and can be used to lift or tilt the composite panel 10 (i.e., by picking the composite panel 10 up from the edge in which the handle rod 50 is embedded) from a horizontal position to a vertical position. The grasping hook may be used by a heavy equipment machine (e.g., fork-lift, back-hoe, crane, etc.) or a hydraulic actuator for purposes of lifting the composite panel 10. To assist with the distribution of loads imparted by the handle rod 50 into the composite panel 10 during lifting, certain embodiments of the present invention provide for the handle rod 50 to be inserted within the inner chamber 26 of a shear connector 20, as shown in FIGS. 10 and 11. In some embodiments, it may be beneficial for the handle rod 50 to be inserted within one of the shear connectors 20 positioned adjacent to an edge of the composite panel 10, and particularly, within the portion of the inner concrete layer 12 that has filled in the inner chamber 26. In such a configuration, the loads imparted by the handle rod 50 to the inner concrete layer 12 may be distributed by the shear connector 20 through to the outer concrete layer 14. In some embodiments, multiple handle rods 50 may be inserted near and/or within multiple shear connectors 20 that are positioned adjacent to an edge of the composite panel 10.

In other embodiments, as shown in FIGS. 12-15, a lifting device in the form of a handle rod 60 and a hairpin support 62 may be used. The handle rod 60 may be similar to the handle rod 50 previously described, except that in place of the flared bottom end 52, the handle rod 60 may include a bottom end 64 in the form of a through-hole, as perhaps best shown in FIG. 15. As shown in FIG. 14, the hairpin support 62 may be in the form of a V-shaped piece of iron, steel, or other sufficiently strong metal. An angled corner of the hairpin support 62 may be received within the throughole of the bottom end 64 of the handle rod 60, such that legs of the hairpin support 62 may extend away from the handle rod 60. Instead of the handle rod 60 and hairpin support 62 being inserted within the inner chamber 26 of a shear connector, embodiments of the present invention may provide for the legs of the hairpin support 62 to extend on either side of a shear connector 20, as shown in FIGS. 12, 13, and 15. To accomplish such positioning of the handle rod 60 and hairpin support 62, the inner concrete layer 12 may be required to be thicker (and the insulation layer 16 thinner) over part of an edge portion of the composite panel 10, as is shown in FIG. 15.

In more detail, as shown in FIG. 12, the handle rod 60 and hairpin support 62 assembly may be used in conjunction with a shear connector 20 over a 2 foot by 2 foot square portion of the composite panel 10 near an edge of the composite panel 10 that is to be lifted (the "lifting portion" of the composite panel 10). As shown in FIG. 15, the insulation layer 16 at the lifting portion of the composite panel 10 is thinner than the remaining portions of the insulation layer 16 used in the composite panel 10. For example, the insulation layer 16 used at the lifting portion may be between 1.5 and 3.5 inches thick, between 2 and 3 inches thick, or about 2.5 inches thick. As such, the inner concrete layer 12 can be thicker at the lifting portion of the composite panel 10 so as to permit the handle rod 60 and hairpin support 62 to extend therethrough and to be sufficiently embedded therein.

With respect to the embodiments shown in FIGS. 12, 13, and 15, the inner concrete layer 12, and particularly the portion of the inner concrete layer 12 located at the lifting portion of the composite panel 10, is sufficiently thick so as to absorb the loads imparted by the handle rod 60 and hairpin support 62 when the composite panel 10 is lifted. As described previously, a top end 66 of the handle rod 60 may extend from the edge of the composite panel 10 or, alternatively, the composite panel 10 may include a recess 56 (See FIG. 13) formed in the inner concrete layer 12 around the top end 66 of the handle rod 60, so as to expose the top end 66. With the top end 66 of the handle rod 60 exposed, a grasping hook (not shown) can be engaged with the top end 66 of the handle rod 60 and can be used to lift or tilt the composite panel 10 (i.e., by picking the composite panel 10 up from the edge in which the handle rod 60 is embedded) from a horizontal position to a vertical position.

Beneficially, with the handle rod 60 and hairpin support 62 positioned close the shear connector 20, the shear connector 20 can act to distribute lifting loads imparted by the handle rod 60 and hairpin support 62 from the inner concrete layer 12 to the outer concrete layer 14. In some embodiments, as shown in FIG. 15, the flanged end-piece 30 of the shear connector 20 engaged within the inner concrete layer 12 may be threadedly shifted down further on the core member 22 such that the flanged end-piece 30 is positioned adjacent to the hairpin support 62. As such, the flanged end-piece 30 can act to further receive and distribute loads imparted by the handle rod 60 and hairpin support 62 through the shear connector 20 and to the outer concrete layer 14. Finally, as perhaps best illustrated in FIGS. 12 and 13, in some embodiments, one or more sections of shear bar 69, which may be in the form of iron or steel rods, may extend along the edge of inner concrete layer 12 through the lifting portion of the composite panel 10. Such shear bars 69 may act to distribute loads imparted by the handle rod 60 and hairpin support 62 through the inner concrete layer 12 such that the handle rod 60 and hairpin support 62 are not inadvertently extracted from the inner concrete layer 12 when the composite panel 10 is being lifted.

Although the shear connector 20 described above includes two flanged end-pieces 30 removably secured to the core member 71, embodiments of the present invention include other shear connector designs. For example, as shown in FIGS. 16-17, embodiments of the present invention may include a shear connector 70 that includes only a single flanged end-piece 30 removably secured (e.g., via threaded portions) to a first end of the core member 71 of the shear connector 70. A second end of the shear connector 70 does not include a flanged end-piece 30. Instead, one or more projection elements 72 extend down from the second end of the core member 22. The projection elements 72 are configured to be engaged within the outer concrete layer 14, such that the shear connector 70 can distribute loads between the inner and outer concrete layers 12, 14 of the composite panel 10. Beneficially, the projection elements 72 extend generally longitudinally downward from the core member 71 and do not extend laterally beyond an outer circumference of the core member 71 (i.e., a diameter extending across opposing projection elements 72 is less than or equal to the maximum diameter of the core member 71). As such, the shear connector 70 can be inserted within an opening formed in the insulation layer 16 by inserting the shear connector 70 into the opening by the second end (i.e., with the projection elements 72 entering the opening first).

FIGS. 18-19 and 20-21, illustrate additional embodiments of a shear connector, with such shear connectors having a unitary design. Specifically, shear connectors 80 (FIGS. 18-19) and 82 (FIGS. 20-21) includes a core member 84, 85, respectively, which are each generally formed as a hollow cylinder. However, as shown in the figures, at least a portion of the core member 84, 85 may be tapered from a maximum exterior diameter at a first end to a minimum exterior diameter at a second end. The shear connectors 80, 82 may have a first flanged end-piece 86, 87, respectively, which are integrally formed with the first ends of the core members 84, 85. As with the flanged end-pieces 30 previously described, the flanged end-pieces 86, 87 may have an outer diameter that is greater than the maximum outer diameter of the core members 84, 85, respectively. In addition, the shear connectors 80, 82 may include flanged end-pieces 88, 89, respectively, which are integrally formed with the second end of the core members 84, 85. In contrast to the flanged end-pieces 86, 87 on the first end of the core members 84, 84, the flanged end-pieces 88, 89 may be formed with an outer diameter that is equal to or less than the maximum outer diameters of their respective core members 84, 85. As such, the shear connectors 80, 82 can be inserted within an opening formed in the insulation layer 16 by inserting the shear connectors 80, 82 into the opening by the second end (i.e., with the flanged end-pieces 88, 89 entering the opening first).

As with the shear connector 20, it may be beneficial if the flanged end-pieces 86, 87 and 88, 89 of the shear connectors 80, 82 are spaced apart from the insulation layer 16 so as to permit the flanged end-pieces 86, 87, and 88, 89 to be embedded within and engaged with the inner and outer concrete layers 12, 14. To insure such positioning, the shear connectors 80, 82 may include one or more support elements that extending from the flanged end-pieces 86, 87 and/or from an exterior surface of the core members 84, 85. For example, as shown in FIG. 20-21, the support elements may be in the form of tabs 90 (similar to tabs 38 of the shear connector 20), which extend downward from the flange-engaging surface 87 to engage with the exterior surface of the insulation layer 16 (See FIG. 20). As shown in FIGS. 20-21, the tabs 90 may be ends of the radially-extending projections, which have been bent downward. Alternatively, as shown in FIG. 18-19, the support elements may in the form of an annular element 92 that extends from an exterior surface of the core member 84 and engages the exterior surface of the insulation layer 16 (See FIG. 18). Regardless, least a portion of the support elements is positioned between the flanged end-pieces 86, 87 on the first ends of the core members 84, 85 and the second end of the core members 84, 85. Additionally, at least a portion of the support elements extends outside the maximum outer circumference of the core members 84, 85. As such, the support elements are configured to support the shear connectors 80, 82 in a position that permits the flanged end-pieces 86, 87 and 88, 89 to be spaced from the insulation layer 16 for being sufficiently embedded in the inner and outer concrete layers 12, 14.

Although the invention has been described with reference to the exemplary embodiments illustrated in the attached drawings, it is noted that equivalents may be employed and substitutions made herein without departing from the scope of the invention as recited in the claims. For example, as described above, some embodiments of the shear connector of the present invention may be formed with only a single flanged end-piece being removably connected (e.g., threadedly connected) to the core member. For instance, FIG. 22 illustrates a shear connector 100 in which only a first flanged end-piece is threadedly connected to a first end of the core member. However, the core member includes a second flanged end-piece, which is integrally formed with a second end of the core member (e.g., compression molded along with the core member). In such an embodiment, when manufacturing a composite panel 10, the first end of the core member may be initially inserted within an opening formed in an insulation layer. The shear connector may be inserted until the second flanged end-piece (i.e., the integral flanged end-piece) on the second end of the core member contacts the insulation layer (alternatively, however, it should be understood that the shear connector may include tabs that extend down from the flanged end-pieces, in which case the shear connector would be inserted until the tabs on the second flanged end-piece on the second end of the core member contact the insulation layer). With the shear connector properly inserted within the insulation layer, the first flanged end-piece can be threadedly secured onto the first end of the core member until the first flanged end-piece (or the tabs extending down from the first flanged end-piece) contact the insulation layer. Thereafter, a composite panel 10 can be manufactured by forming the concrete layers on either side of the insulation layer, as was previously described.

What is claimed is:

1. A shear connector for use with a concrete panel comprising first and second spaced-apart concrete layers, said shear connector comprising:

an elongated core member comprising a first end and a second end, wherein said core member includes a hollowed interior space, wherein the interior space of said core member is separated into multiple chambers, wherein said core member is configured to house a thermally insulative material within at least one of the chambers of the interior space of said core member, wherein the thermally insulative material is a different material than a material from which said core member is formed;

a first flanged end-piece secured to said first end of said core member; and a second flanged end-piece secured to said second end of said core member, wherein at least a portion of each of said first and second flanged end-pieces is wider than said core member, wherein said shear connector is configured to transfer shear forces.

2. The shear connector of claim 1, wherein said thermally insulative material comprises foam and/or air.

3. The shear connector of claim 1, wherein said first and second flanged end-pieces are each formed of a fiber-reinforced composite material.

4. The shear connector of claim 1, wherein said core member is formed of a fiber-reinforced synthetic resin material.

5. The shear connector of claim 1, wherein a length of said core member is between 2 and 6 inches, wherein a maximum diameter of said core member is between 2 and 8 inches, and wherein a ratio of the length of said core member to the maximum diameter of said core member is between 1:1 to 3:1.

6. The shear connector of claim 1, wherein said core member does not extend outwardly past said first and second flanged end pieces.

7. The shear connector of claim 1, wherein said core member comprises a substantially hollow cylinder, and wherein said core member includes a separation member extending across the interior space of said core member so as to prevent fluid flow though the interior space of said core member.

8. The shear connector of claim 1, wherein each of said first and second flanged end-pieces is removably secured to said core member.

9. The shear connector of claim 7, wherein at least one of said first flanged end-piece and said second flanged end piece is threadedly secured to said core member, such that a position of said at least one flanged end-piece can be adjusted along a length of said core member.

10. A concrete panel comprising:

a first concrete layer;

a second concrete layer spaced from said first concrete layer; and a plurality of shear connecters connecting said first and second concrete layers, wherein each of said shear connectors includes— an elongated core member comprising a first end and a second end, wherein said core member comprises a hollowed interior space, and wherein the interior space of said core member is separated into multiple chambers;

a first flanged end-piece secured to said first end of said core member and at least partially embedded within said first concrete layer, a second flanged end-piece secured to said second end of said core member and at least partially embedded within said second concrete layer, wherein each of said shear connectors is configured to transfer shear forces between said first concrete layer and said second concrete layer, and to prevent delamination of said first concrete layer and said second concrete layer; and a thermally insulative material positioned within at least one of the chambers of the interior space of said core member, wherein the thermally insulative material is a different material than a material from which said core member is formed.

11. The concrete panel of claim 10, wherein the thermally insulative material positioned within the interior space of each core member comprises foam and/or air.

12. The concrete panel of claim 10, further comprising an insulation layer between said first and second concrete layers, wherein each elongated core member extends through said insulation layer.

13. The concrete panel of claim 10, wherein each core member comprises a substantially hollow cylinder, and wherein said core member includes a separation member extending across the interior space of said core member.

14. The concrete panel of claim 10, wherein a length of each core member is between 2 and 6 inches, wherein a maximum diameter of each core member is between 2 and 8 inches, wherein a thickness of said insulated concrete panel is between 3 and 18 inches, and wherein a ratio of the length of each core member to the maximum diameter of each core member is between 1:1 to 3:1.

15. The concrete panel of claim 10, wherein said first and second concrete layers are formed of ultra-high performance concrete comprising reinforcing fibers.

16. The concrete panel of claim 10, wherein each of said first and second flanged end-pieces is formed of a fiber-reinforced composite material.

17. A method of making a concrete panel, said method comprising the steps of:

(a) providing a plurality of shear connectors, each comprising— an elongated core member comprising a first end and a second end, wherein the core member comprises a hollowed interior space, and wherein the interior space of the core member is separated into multiple chambers, a first flanged end-piece secured to the first end of the core member, and a second flanged end-piece secured to the second end of the core member;

(b) forming a first layer of concrete— with the first flanged end-piece of each of the shear connectors at least partially embedded within the first layer of concrete; and (c) forming a second layer of concrete with the second flanged end-piece of each of the shear connectors at least partially embedded within the second layer of concrete, wherein the first and second layers of concrete are spaced from one another, and wherein the plurality of shear connecters connect the first and second layers of concrete, wherein a thermally insulative material is housed within at least one of the chambers of the interior space of the core member of each of the shear connectors, wherein the thermally insulative material is a different material than a material from which the core member is formed, wherein each of the shear connectors is configured to transfer shear forces between the first layer of concrete and the second layer of concrete, and to prevent delamination of the first layer of concrete and the second layer of concrete.

18. The method of claim 17, wherein the thermally insulative material housed within the interior space of each of the core members comprises foam and/or air.

19. The method of claim 17, wherein each of the flanged end pieces is formed of a fiber-reinforced composite material.

20. The method of claim 19, wherein a length of each of the core members of the shear connectors is between 2 and 6 inches, wherein a maximum diameter of each of the core members is between 2 and 8 inches, wherein a thickness of the concrete panel is between 3 and 18 inches, and wherein a ratio of the length of each of the core members to the maximum diameter of each of the core members is between 1:1 to 3:1.

21. The method of claim 17, wherein said first and second layers of concrete are formed of ultra-high performance concrete comprising reinforcing fibers.

22. The method of claim 17, wherein the shear connectors extend through an insulation layer between the first layer of concrete and the second layer of concrete, and wherein the insulation layer comprises a sheet of rigid insulative material.

* * * * *